US006056215A

United States Patent [19]

Hansinger et al.

[11] Patent Number: 6,056,215

[45] Date of Patent: May 2, 2000

[54] ELECTROSTATIC ROTARY ATOMIZING SPRAY DEVICE

[75] Inventors: Michael P. Hansinger, Olmsted Falls; Harold Beam, Oberlin; Dennis J. Davis, Bay Village; Ronald R. Schroeder, Amherst; Carl Bretmersky, North Olmsted; Stephen Lee Merkel, Bay Village; Thomas Andreas Trautzsch, Macedonia, all of Ohio

[73] Assignee: Nordson Corporation, Westlake, Ohio

[21] Appl. No.: 08/834,290

[22] Filed: Apr. 16, 1997

Related U.S. Application Data

[63] Continuation-in-part of application No. 08/404,355, Mar. 15, 1995, Pat. No. 5,697,559.

[51] Int. Cl.[7] ..... B05B 5/04

[52] U.S. Cl. ..... 239/703; 239/704

[58] Field of Search ..... 239/3, 690, 691, 239/699–705, 214.25, 223, 224

[56] References Cited

U.S. PATENT DOCUMENTS

| | | | |
|---|---|---|---|
| 4,361,288 | 11/1982 | Fukuda et al. | 239/703 |
| 4,405,086 | 9/1983 | Vetter | 239/224 |
| 4,450,785 | 5/1984 | Meisner | 239/223 X |
| 4,572,437 | 2/1986 | Huber et al. | 239/703 |
| 4,589,597 | 5/1986 | Robisch et al. | 239/703 |
| 4,605,168 | 8/1986 | Tachi et al. | 239/112 |
| 4,723,726 | 2/1988 | Ooishi et al. | 239/703 |
| 4,776,520 | 10/1988 | Merritt | 239/700 |
| 4,838,487 | 6/1989 | Schneider | 239/223 |
| 4,844,348 | 7/1989 | Rutz | 239/703 |
| 4,866,987 | 9/1989 | Willson et al. | 73/655 |
| 4,877,770 | 10/1989 | Wacker et al. | 239/703 |
| 4,878,454 | 11/1989 | Cann | 118/663 |
| 4,936,507 | 6/1990 | Weinstein | 239/71 |
| 4,943,005 | 7/1990 | Weinstein | 239/223 |
| 4,947,035 | 8/1990 | Zook et al. | 250/225 |
| 4,987,001 | 1/1991 | Knobbe et al. | 427/28 |
| 5,078,321 | 1/1992 | Davis et al. | 239/224 |
| 5,100,057 | 3/1992 | Wacker et al. | 239/223 |
| 5,153,512 | 10/1992 | Glasheen | 324/175 |
| 5,204,619 | 4/1993 | Beigbeder et al. | 324/175 |
| 5,346,139 | 9/1994 | Davis et al. | 239/703 |
| 5,397,063 | 3/1995 | Weinstein | 239/703 |

FOREIGN PATENT DOCUMENTS

| | | |
|---|---|---|
| 574305 | 6/1993 | European Pat. Off. . |
| 600397 | 11/1993 | European Pat. Off. . |
| 1107060 | 3/1968 | United Kingdom . |

OTHER PUBLICATIONS

*"New Rotary Bell for Metallic Paint Application"* Metal Finishing, Oct. 1993 ©Copyright Elsevier Science Publishing Co., Inc.

*Primary Examiner*—Lesley D. Morris
*Attorney, Agent, or Firm*—Calfee, Halter & Griswold LLP

[57] ABSTRACT

A rotary atomizer has an internal power supply in the atomizer housing about which is passed cooling air. The air then flows out of the atomizer housing in a twisting direction as vectored air in the same direction of rotation as the atomizer head to eliminate any vacuum condition around the atomizer head and to provide shaping control of the coating being sprayed. A portion of the exhaust air from an air turbine motor driving the atomizer head with a turbine shaft is directed through a passageway between a stationary fluid tube within the turbine shaft and the rotary shaft to direct the exhaust air into the atomizer head to mix with the coating and create an air barrier that prevents coating material from leaking back into the rotary atomizer device. The remaining portion of the exhaust air from the air turbine motor is channeled around the outside surface of the housing of the rotary atomizer device to prevent liquid coating material from wrapping back and attaching to the atomizer housing.

26 Claims, 11 Drawing Sheets

ELECTROSTATIC ROTARY ATOMIZING SPRAY DEVICE

RELATED APPLICATIONS

This application is a continuation-in-part application of U.S. patent application Ser. No. 08/404,355, since issued as U.S. Pat. No. 5,697,559, entitled ELECTROSTATIC ROTARY ATOMIZING SPRAY DEVICE, filed Mar. 15, 1995, and assigned to the common assignee with the present invention.

This application also relates to U.S. patent application Ser. No. 08/264,606, since issued as U.S. Pat. No. 5,474,236 entitled TRANSFER OF ELECTROSTATIC CHARGE THROUGH THE HOUSING OF A ROTARY ATOMIZING SPRAY DEVICE, filed Jun. 23, 1994, and assigned to the common assignee with the present invention.

FIELD OF THE INVENTION

This invention relates to a rotary atomizer device for spraying a liquid coating material and more particularly to a rotary atomizer device wherein high electrostatic charge is transferred from an internal power supply to a high speed atomizer head secured to a shaft driven by an air turbine motor. A portion of the exhaust air from the air turbine motor is channeled through the shaft driven by the air turbine motor and into the high speed atomizer head to mix with the liquid coating material and to create an air barrier that prevents liquid coating material being dispensed by the atomizer head from leaking back into the rotary atomizer device causing premature mechanical failure. The remainder of the exhaust air from the air turbine motor is channeled around the outside surface of the housing of the rotary atomizer device to prevent liquid coating material from wrapping back and attaching to the atomizer housing.

BACKGROUND OF THE INVENTION

Rotary atomizers are a type of liquid spray coating device which includes an atomizer head rotatable at high speed (typically 10,000–40,000 revolutions per minute) by an air turbine motor to apply liquid coating material, such as paint, in atomized form onto the surface of a workpiece. The atomizer head is usually in the form of a disc or cup which includes an interior wall that defines a cavity and terminates in an atomizing edge. Liquid coating material delivered to the interior of the cup flows outwardly under centrifugal force along the interior wall of the cup and is expelled radially outward from the peripheral edge of the cup to form a spray pattern of atomized droplets of coating material. To improve the transfer efficiency of the coating process, an electrostatic charge is imparted to the coating material so that the pattern of atomized coating material is attracted to an electrically grounded workpiece.

An example of an electrostatically charged rotary atomizer is disclosed in commonly assigned U.S. Pat. No. 4,887,770 ('770) to Wacker et al., which is expressly incorporated herein in its entirety by reference. In the FIG. 12 embodiment of the '770 patent, the cup (20) is made from an insulative material and includes a semi-conductive ring (546) which is charged through posts (504) by three external electrode probes (462). This system suffers from a drawback in that the front end of the housing from which the cup protrudes has a large profile that causes the air currents, generated by the high speed rotation of the cup, to create a vacuum around the front end of the housing which in turn causes the paint to wrap back onto the housing. Also, there is a need to shape the pattern of atomized coating material being sprayed from the rotary atomizer. The first problem has been addressed by directing auxiliary air from a first source of auxiliary air around the front end of the housing to break up the vacuum and thereby prevent paint wrapback. The second problem was addressed by directing auxiliary air from a second source of auxiliary air around the cup for shaping the pattern of atomized coating material being sprayed from the rotary atomizer. The need to provide two separate sources of air complicates the construction of the atomizer and can reduce the effectiveness of each air flow when the two air flows intermingle with each other. Thus, there still exists a need for an atomizer that further reduces or eliminates wrapback and does not require two separate flows of air to be directed toward the cup for breaking up the vacuum and shaping the material being sprayed.

Prior to the '770 patent, one of the hazards associated with the use of the conductive atomizing cup was the possibility of operator shock or ignition of combustible coatings because of the high voltage at which the cups were maintained. For example, as disclosed in U.S. Pat. No. 4,369,924, a charge is transferred through a turbine shaft from a power supply to the rotary atomizer cup. Since, both the cup and the entire rotary atomizing housing are metal and are charged to a high voltage, there is a significant safety hazard since the atomizer carries sufficient charge to severely shock an operator. Therefore, protective fences and interlocks have to be installed around the atomizer.

The '770 patent, listed before, discloses a low capacitance, rotary atomizer which, while electrostatically charging the coating paint at the rotary atomizer cup, does not store sufficient charge to present a shock hazard and therefore does not have to be protected by fences and safety interlocks. To charge the atomizer in the '770 patent, external electrode probes (462) direct the charge into the cup (20). However, since the cup (20) is charged through external electrode probes (462), the system suffers from the drawback that the front end of the housing has a large profile which causes the attendant wrapback problems discussed before.

Another problem associated with prior art rotary atomizers is that the rotary atomizer cups have not been easy to disassemble and clean. For example, in U.S. Pat. No. 4,838,487, a deflecting member (28) is held in place against atomizing bell (10) by spacers (36). However, in operation, dried paint can collect on the front surface (30) of the deflector member. Then, the flow of paint across the front surface with the dried paint has a tendency to form an irregular coating on the part being sprayed.

In operating rotary atomizers, an important control parameter is the speed of the air turbine. The measurement of this speed is typically accomplished with a fiber optic cable. The rear surface of the air turbine disk is colored so that one half of the surface is black and the other half silver. The difference between the two colors is sensed with a fiber optic transceiver and a signal output through a fiber optic cable to a control unit. In the control unit, the signal can be conditioned to determine the speed in revolutions per minute (RPM) of the air turbine disk. The problem with this design is that the fiber optic cable cannot withstand extended cyclical flexing (to which it is subjected during operation in a manufacturing plant) for a long enough period of time and tends to break. Also, fiber optic cable is normally encased in a sheath that cannot provide high voltage isolation required in the presence of an internally located power supply. Still another problem with the prior art designs is that the fiber optic transceiver cannot be quickly disconnected from and reconnected to the rotary atomizer without recalibration.

During the operation of the rotary atomizers, the paint can collect on the front surface of the rotary atomizer member and sometimes flow back into the atomizer device through the space formed between a stationary paint tube and the rotating turbine shaft and ultimately migrate into the atomizer device causing it to malfunction by problems such as clogged bearings.

OBJECTS AND SUMMARY OF THE INVENTION

It is an object of the present invention to provide an improved electrostatic rotary atomizing spray device being as defined in one or more of the appended claims and, as such, having the capability of being constructed to accomplish one or more of the following subsidiary objects.

It is another object of the present invention to provide a rotary atomizer device for spraying a liquid coating and method of operating same wherein high electrostatic charge is generated by an internal power supply located within the housing of the rotary atomizer.

Another object of the present invention to provide a rotary atomizer device for spraying a liquid coating and method of operating same wherein exhaust air from the air turbine motor is channeled around the outside surface of the housing of the rotary atomizer device to prevent liquid coating material from wrapping back and attaching to the atomizer housing.

Yet another object of the present invention to provide a rotary atomizer device for spraying a liquid coating and method of operating same wherein vectored air from an external air supply is directed across the internal power supply and out of the atomizer housing in a direction that is twisted about the axis of rotation of the atomizer head to eliminate a vacuum condition around the atomizer head and to provide shaping control of the coating being sprayed.

It is a further object of the present invention to provide an apparatus and method for measuring the rotational speed of the air turbine motor in the rotary atomizer device with a speed sensor that can properly operate in the presence of high electrostatic charge and radio frequency fields.

It is still another object of the present invention to provide a rotary atomizer device for spraying a liquid coating and method of operating same wherein an atomizing head includes an insert which divides the flow of coating material into a plurality of liquid streams to improve the distribution of the flow being propelled from the atomizing head.

Still another object of the present invention is to provide a rotary atomizer device for spraying a liquid coating and method of operating same wherein the atomizing head includes an insert that wets the front flow surface of the atomizer head during operation so that the atomizing head is easier to clean.

It is still a further object of the present invention to provide an apparatus and method for transferring charge to a high speed atomizer head through a semi-conductive annular ring mounted to the front of the rotary atomizer housing so that the charge is dissipated within the ring to prevent the need for protecting an operator from being shocked.

Still another object of the present invention is to provide a novel intrinsic safety barrier for the power supply of an electrostatic spray device.

Yet another object of the present invention is to direct a portion of the exhaust air from an air turbine motor of a rotary atomizer device into an atomizing head to mix with the coating material in the atomizing head to and improve the dispersion of the liquid coating material being sprayed from the atomizer head. Also, the portion of exhaust air keeps the head cleaner and creates an air barrier that prevents coating material from leaking back into the rotary atomizer device.

In accordance with the invention, an electrostatic rotary atomizing spray device comprises an atomizer housing having forward, intermediate, and rear sections which enclose an interior chamber. An annular ring is detachably mounted to the forward section of the atomizer housing. The annular ring has a front surface provided with a circular bore forming an air flow surface therethrough. An atomizing head, with an axis of rotation therethrough, has a first surface over which liquid coating can flow outwardly to an atomizing edge thereof when the atomizer head is rotated about the axis of rotation. A rotary drive extends at least partially through the interior chamber of the atomizing housing and mounts the atomizing head to an air turbine motor for rotating the atomizing head in a first direction about the axis of rotation. The atomizing head at least partially projects into the circular bore of the annular ring to define a gap between the atomizing head and the circular bore. A flow of vectored air is directed through the atomizing housing to the gap. An air control element, mounted in the gap between the atomizing head and the circular bore, directs the flow of vectored air through the gap and against the atomizing head at an angle to the axis of rotation so that the flow of vectored air is generally twisted about the axis of rotation in the first direction.

According to the invention, the air control element comprises a plurality of slots in the air flow surface of the circular bore. The slots are spaced from one another and disposed at an angle of about 5 degrees to about 60 degrees with respect to the axis of rotation. The slots direct the flow of vectored air against the atomizing head to both eliminate any vacuum pressure condition on the atomizing head caused by the rotation of the head and to substantially eliminate paint wrapback onto the head, the annular ring, and the atomizer housing. In addition, the vectored air shapes the pattern of paint being expelled from the head.

Also according to the invention, a speed detecting device use in an electrostatic rotary atomizing spray device powered by an air turbine motor is disclosed. The turbine motor includes a turbine housing containing a turbine wheel which rotates a rotary drive shaft about an axis of rotation. The drive shaft, being connected to an atomizing head, also rotates the atomizing head about the axis of rotation. Permanent magnets are affixed to the turbine wheel and arranged thereon to rotate concentric with the axis of rotation. A detecting head is mounted to the turbine housing and spaced from the turbine wheel. The detecting head has a pole piece with a first end in a pickup coil and a second opposite end projecting into the turbine housing and disposed adjacent to but free of contact with the permanent magnets. As the turbine wheel spins, the pole piece cuts the magnetic field generated by the permanent magnets and causes the induction coil to output a signal representing the rotation of the turbine wheel. An infrared light emitting electrode receives the output signal from the induction coil and outputs a corresponding infrared light signal. A photo transducer, in spaced relation to the infrared light emitting electrode, is disposed on a circuit board to generate a low voltage output signal in response to the infrared light signal from the light emitting electrode. The photo transducer and the circuit board are entirely encased with a sheath of conductive material. A monolithic casing of translucent, dielectric material covers the sheath of conductive material and allows the light signal from the light emitting device to shine onto the photo transducer. The photo transducer, in turn, generates the low voltage output signal without interference from the high voltage or RF fields generated by the closely situated internal power supply.

According to the invention, the electrostatic rotary atomizing liquid spray device also includes a high voltage electrostatic power supply mounted within the intermediate section of the atomizer housing between the turbine drive and the forward section of the atomizer housing for outputting high voltage electrostatic charge to the atomizing head. The power supply has a ring like shape and is spaced from the inner walls of the intermediate section to form an air gap therebetween. An exhaust conduit directs exhaust air from the air powered turbine drive to cool the power supply. A circuit is provided for transferring the high voltage electrostatic charge from the internal power supply into the semi-conductive annular ring and then across the air gap into the atomizing head. The semi-conductive annular ring is constructed of a semiconductive composite material so that the high voltage electrostatic charge being transferred across the gap and into the atomizing head will dissipate throughout the ring. An intrinsic safety circuit of the novel design disclosed herein can be included to control the power delivered to the power supply.

According to the invention, a rotary atomizing head or cup for atomizing coating material comprises a rotatable cup body having a longitudinal axis therethrough and formed with an inner flow surface which directs the flow of coating material to the face of the cup, and an outer surface which directs the flow of shaping and vectored air. The cup body has an hourglass like shape. Paint, introduced into the interior of the cup, flows from the interior along the forward face of the cup and is expelled in a uniform, circular pattern from the edges of the cup. The paint is electrostatically charged by contact with the high voltage charge carried by the cup.

According to the invention, the rotary atomizing cup can include a conical insert positioned coaxially with the longitudinal axis and mounted in the conical surface of the nozzle receiving portion to define a gap therebetween. The gap forms a flow path for the flow of coating material exiting from the nozzle to the forward flow surface of the cup. A plurality of ribs can be provided, each extending outwardly from the conical surface of the conical insert. The ribs are spaced from one another and divide the coating material flowing along the conical surface into a number of finely divided, individual streams of coating material for discharge through the gap and onto the forward flow surface. Preferably, the plurality of ribs extend outwardly from the conical surface to abut against the conical insert whereby the flow of coating material is restricted to the enclosed space formed between the conical insert, the conical surface, and adjacent ribs. The insert is constructed of a semiconductive material and can, in an alternative embodiment, include electrodes projecting outward from the front surface of the insert to provide an electrostatic field on the front surface of the insert. The rotary atomizer cup can also include a plurality of second ribs, each extending outwardly from the forward flow surface. The second ribs are spaced from one another to further divide the coating material flowing along the forward flow surface into individual streams of coating material for discharge from the atomizing lip of the cup body as atomized droplets of coating material.

According to another embodiment of the invention, a rotary atomizing cup for atomizing coating material is designed to keep the center of the cup wet with coating to make it easier to clean.

According to still another embodiment of the invention, the electrostatic rotary atomizing spray device for spraying a liquid coating material includes an air passage, such as between the fluid tube and the rotary drive shaft, for directing air through the interior of the atomizer head so that both the air and the liquid coating material flow together and the liquid coating material is prevented from flowing down the air passage. An air passageway within the atomizing spray device directs a first portion of the exhaust air from the air turbine motor connected to the rotary drive shaft into the air passage to flow to the atomizer head and a second portion of the exhaust air to a location external to the atomizer housing. The rotary atomizer head has a flow distributor mounted therein to direct the flow of the coating material from the fluid tube through a first flow passage to a forward flow surface of the rotary atomizer head and a second flow passage to direct the flow of exhaust air from the air passage to the first flow passage to mix with the coating material as it flows to the forward flow surface of the rotary atomizer head.

BRIEF DESCRIPTION OF THE DRAWINGS

The structure, operation, and advantages of the presently preferred embodiment of the invention will become further apparent upon consideration of the following description taken in conjunction with the accompanying drawings, wherein.

DETAILED DESCRIPTION OF THE INVENTION

Figure 1:
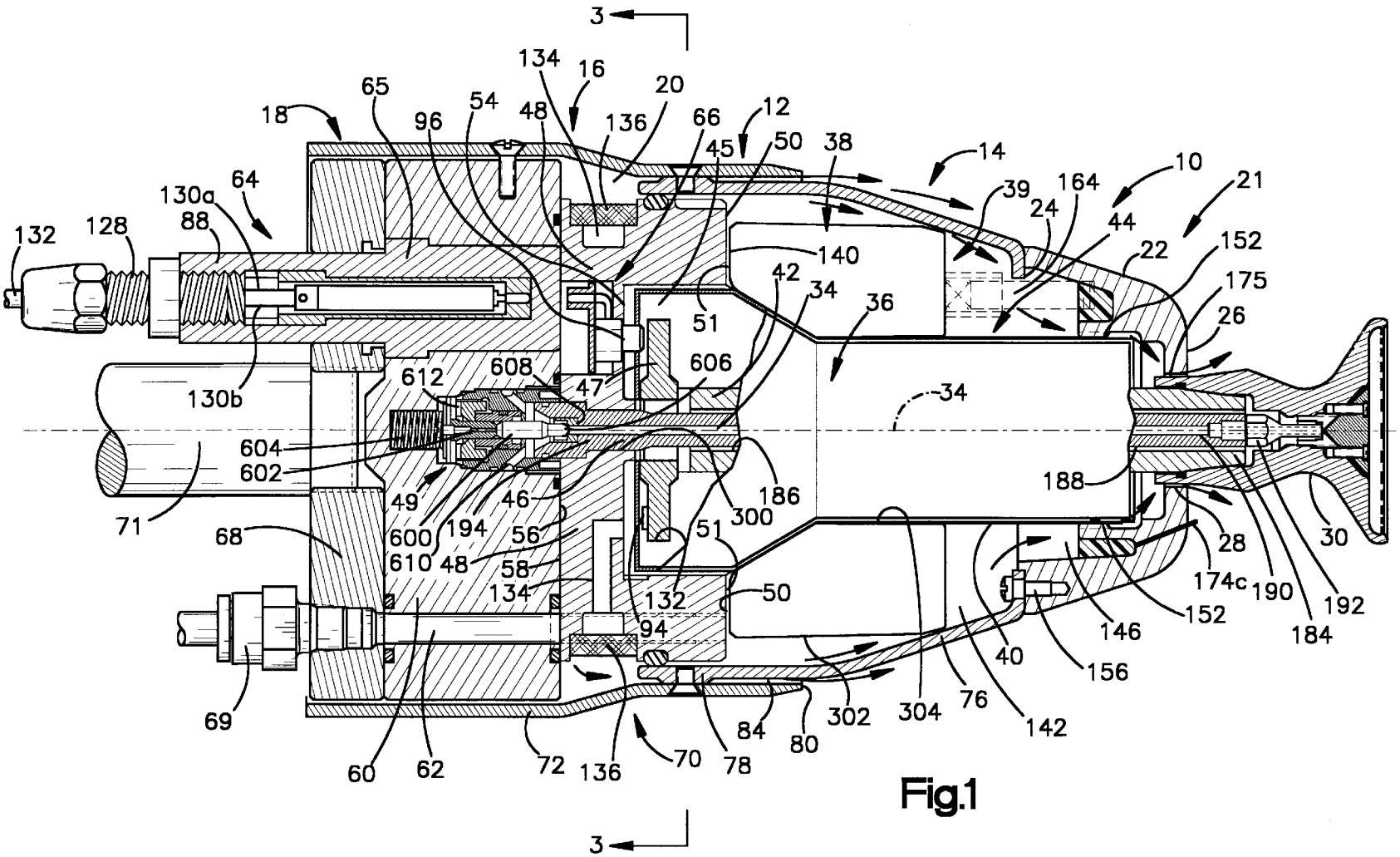
FIG. 1 is a cross sectional side view of a rotary atomizer in accordance with the present invention.

Referring to FIG. 1, an electrostatic, liquid spray, rotary atomizer 10, constructed in accordance with the invention, is shown. The rotary atomizer 10 includes an atomizer housing 12 having a forward section 14, an intermediate section 16, and a rear section 18 which define an interior chamber 20.

Figure 5:
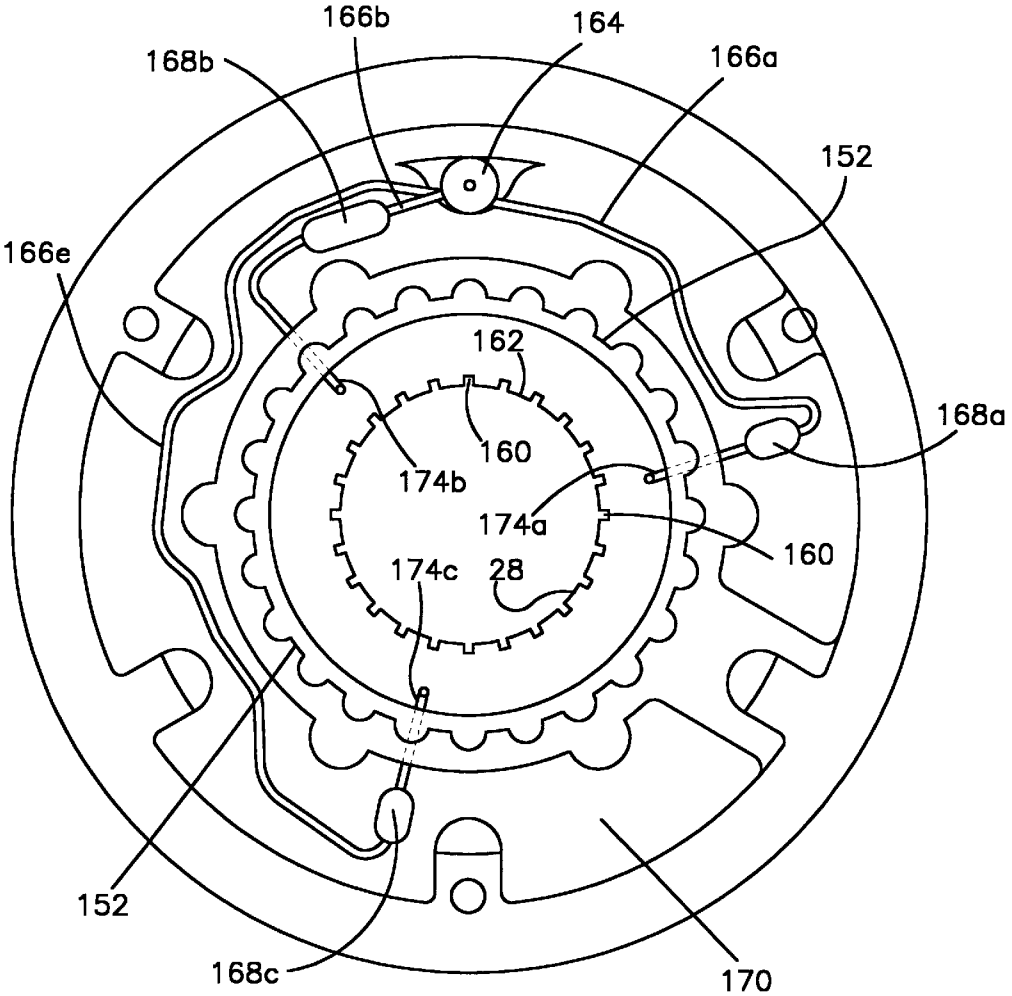
FIG. 5 is a rear view of the annular ring of FIG. 4 showing the resistors embedded in the annular ring.
Figure 4:
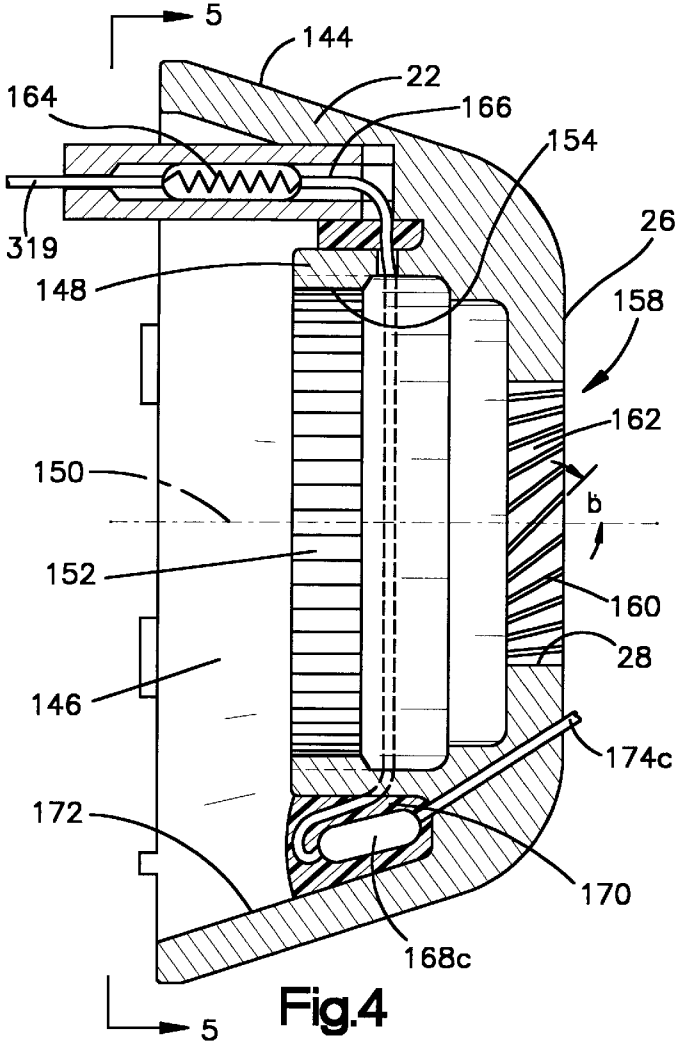
FIG. 4 is a side view, in cross section, of a semi-conductive annular ring disposed at the front end of the atomizer housing shown in FIG. 1, both for dissipating high electrostatic charge being transferred to the high speed atomizer head and for directing a flow of vectored air onto the atomizer head to prevent paint wrap back onto the atomizer housing and for shaping the spray of paint.

An air control element 21 incorporates an annular ring 22, shown in detail in FIGS. 4 and 5, is detachably mounted to the front surface 24 of forward section 14. Annular ring 22 has a front wall 26 provided with a circular bore 28 about an axis 150 which (when air control element 21 is assembled on forward section 14) is coincident with a longitudinal axis of rotation 34 that extends through atomizer housing 12.

Figure 17:
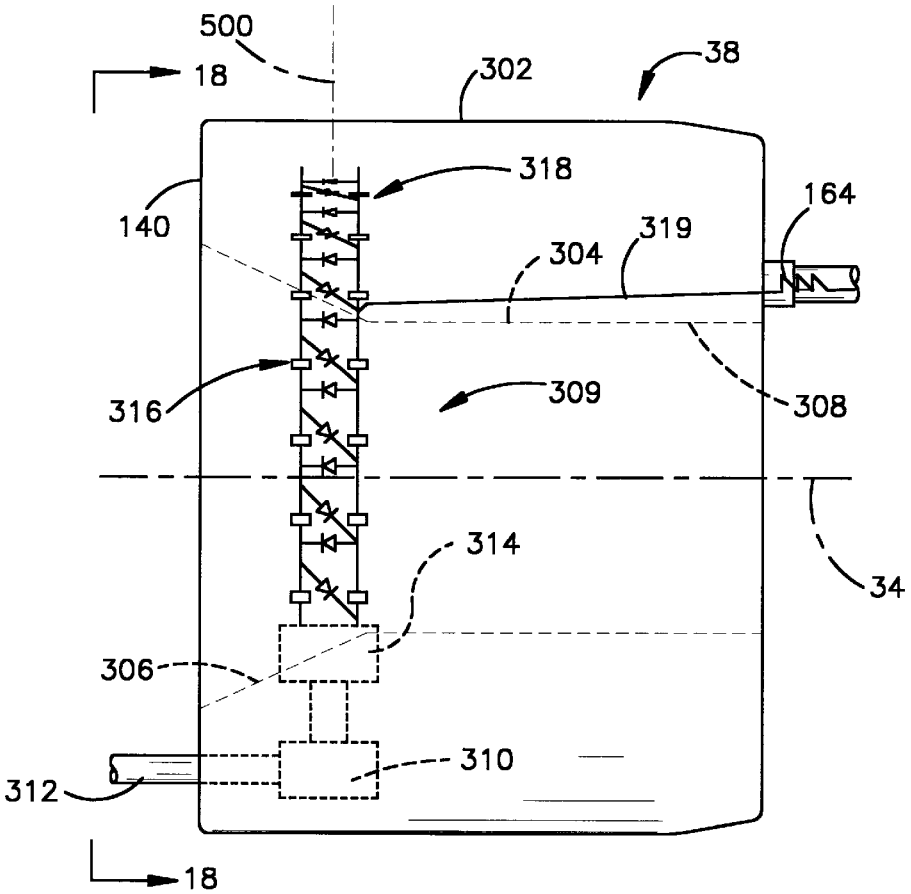
FIG. 17 is a side view of a power supply.
Figure 18:
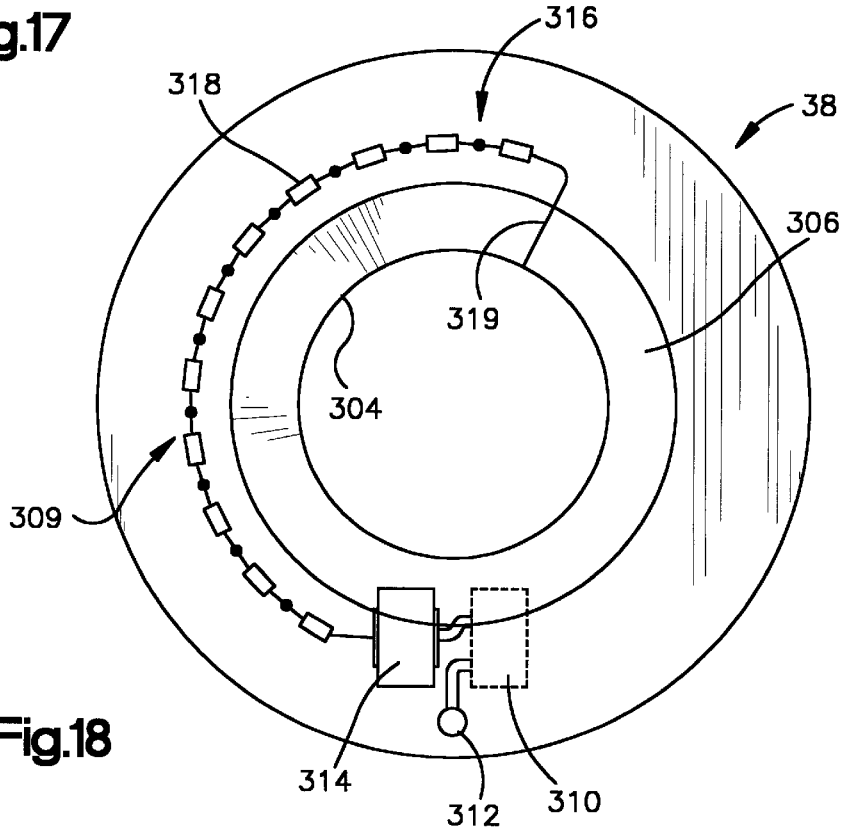
FIG. 18 is a view along line 18—18 of FIG. 17.

An internal power supply 38, located within interior chamber 20, generates high voltage electrostatic energy in the range of from about 30,000 volts DC to about 100,000 volts DC. Power supply 38, as shown in FIGS. 17 and 18, has a doughnut shaped, cylindrical configuration with a throughbore 304 and is disposed about rotary drive mechanism 36. Power supply 38 is electrically connected to air control element 21 by electrical voltage transfer means 39, including an electrical circuit 309, described below.

Rotary drive mechanism 36, located within the interior chamber 20 of rotary atomizer 10, is preferably an air driven type turbine motor 44 which includes internal air bearings (not shown), a driving air inlet (not shown), and a braking air inlet (not shown) for controlling the rotational speed of a turbine wheel 47, all of which components are well known in the art. Turbine motor 44 includes a rotary drive shaft 42 that extends through and is rotatably supported within a turbine housing 40. Rotary drive shaft 42 extends through circular bore 28 of annular ring 22 and has an atomizer cup or head 30 mounted at one end. Drive shaft 42 further extends into a turbine drive wheel housing 45 at the opposite end and is mounted to turbine wheel 47.

A stationary, liquid flow tube 46 extends completely through rotary drive mechanism 36, and is in fluid communication with an air operated valve 49 at one end and atomizing head 30 at the opposite end for transferring a liquid coating from the valve to the atomizing head. Valve 49 has a valve shaft 600 connected to a piston 602. A spring 604 pushes against piston 602 to press the ball shaped end 606 of shaft 600 against valve seat 608. Paint is supplied through passages (not shown) in valve plate 60 and manifold plate 68 to paint inlets 610. To allow paint to pass through valve 49 into tube 46, compressed air is supply through passages (not shown) in valve plate 60 and manifold plate 68 to air chamber 612 which is on the opposite side of piston 602 from spring 604. The compressed air moves piston 602 to the left in FIG. 1 to compress spring 604 and retract valve end 606 from seat 608 to allow a paint to flow through valve 49 into tube 46.

Figure 3:
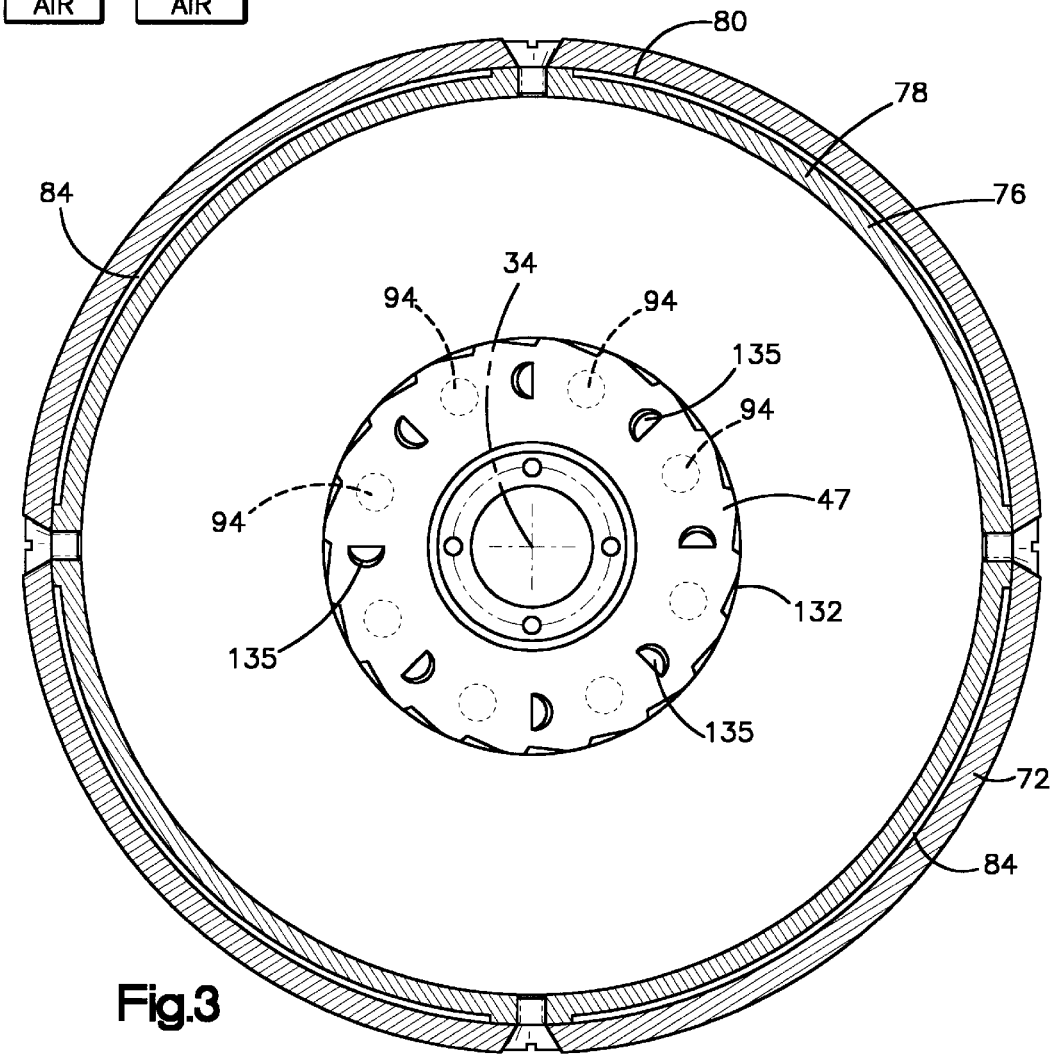
FIG. 3 is a view along line 3—3 of FIG. 1 showing the turbine with the embedded magnets shown with phantom lines in accordance with the invention.

Referring to air turbine motor 44, a source of pressurized turbine drive air is connected by a passageway (not shown) through manifold plate 68 and valve plate 60 to the turbine wheel housing 45 to spin air turbine drive wheel 47, as shown in FIG. 3, according to conventional practice. That is, the stream of turbine drive air is directed against the outer perimeter 132 of drive wheel 47 to rotate the wheel about the longitudinal axis 34 extending through rotary atomizer 10. A source of brake air is also connected by a passageway (not shown) through manifold plate 68 and valve plate 60 to the turbine wheel housing 45 for application against upstanding brake buckets 135 projecting from the side face of turbine wheel 47. Preferably, magnets 94 are imbedded within the drive wheel 47 and, if desired, can project outward from the face of the drive wheel as shown in FIG. 1 and discussed below.

In assembling rotary atomizer 10, power supply 38 is inserted into forward section 14 and rotary drive mechanism 36 is inserted within throughbore 304 through the power supply. Then, an interface plate 48 is installed from the rear section 18 of atomizer housing 12 so that its front face 50 is spaced from power supply 38 to define a narrow air gap 51 which forms a flow path for cooling vectored air, as described in detail below. A protruding center portion 300 of interface plate 48 abuts against turbine wheel housing 45 to firmly secure turbine motor 44 within atomizer housing 12. Abutted against a rear surface 56 of interface plate 48 is the front surface 58 of a valve plate 60 in which air operated valve 49 for controlling the liquid flow through flow tube 46 is located. Air supply passageways, such as turbine air and brake air supply passageways (not shown) and vectored air supply passageway 62, extend through valve plate 60. A speed monitoring device or system 64 has a signal processing portion 65 disposed in valve plate 60 and a signal detection portion 66 mounted in interface plate 48, as discussed in more detail below. The rear portion of speed monitoring system 64 extends through a manifold plate 68 mounted within rear section 18 of rotary atomizer housing 12. The manifold plate 68 has a plurality of fittings including, but not limited to, a vectored air fitting 69, a bearing air fitting (not shown), a turbine driving air fitting (not shown), a turbine braking air fitting (not shown), a coating supply fitting (not shown), speed monitor 64 utilized to carry signals representing the speed of air turbine motor 44, and an axially extending stud assembly 71 for attachment of rotary atomizer 10 to a device for positioning the rotary atomizer at a work station such as an industrial robot or reciprocating mechanism (not shown).

The atomizer housing 12, as shown in FIG. 1, includes an outer casing 70 with a larger diameter rear end section 72 enclosing manifold plate 68, valve plate 60, and interface plate 48. Outer casing 70 also includes a tapered front end section 76 which has a cylindrical, rear end portion 78 received within the open front end 80 of the rear end section 72 of outer casing 70. A air gap 84, as seen in FIG. 3, formed by the spacing between the large diameter front end 80 of rear end section 72 and the smaller diameter cylindrical rear end portion 78 of front end section 76, provides an exhaust path for the air exhausted from the turbine wheel housing 45, as discussed in more detail below.

SPEED CONTROL

A principle feature of this invention relates to the speed monitoring device 64 for measuring the rotational speed of the air driven, turbine wheel 47 mounted in turbine wheel housing 45 of air turbine motor 44. The turbine wheel 47, as shown in FIG. 3, is fitted with a plurality of magnets 94, such as for example eight, which rotate about the axis of rotation 34. While it is generally known to fit an air turbine motor with a magnetic pickup for generating pulses representing revolutions of the turbine and outputting feedback signals to suitable monitoring and display equipment, in the present environment where power supply 38 located in the immediate vicinity of turbine motor 44, radio frequency (RF) waves emanating from the power supply must be isolated from the feedback signals which would otherwise become distorted and prevent accurate determination of turbine wheel speed. In addition, speed sensor 64 must be isolated from the 30,000 to 100,000 volts generated by high voltage power supply 38. Otherwise, as with the RF waves, the feedback signals would be completely distorted by the high voltage and this would prevent accurate determination of turbine wheel speed.

Figure 2:
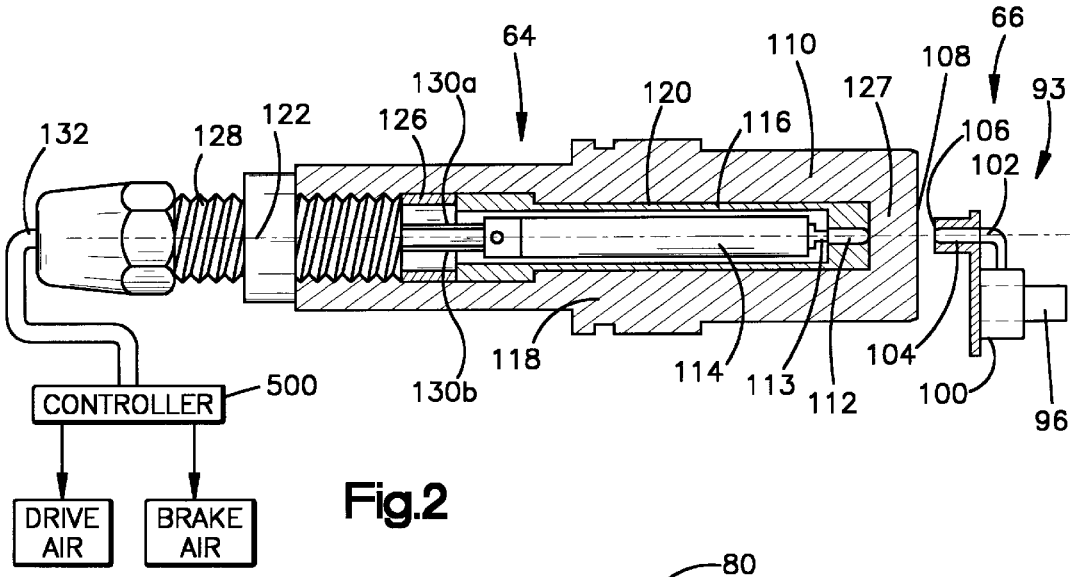
FIG. 2 is a cross sectional side view showing a speed sensor for measuring the rotational speed of an air powered turbine motor in the rotary atomizer of FIG. 1.

The speed monitoring device 64, as seen in FIG. 2, includes a signal detection portion 66 constructed of a bobbin fixture 93 with a cylindrical pole piece 96 that projects through an aperture in the wall of interface plate 48. Pole piece 96 is disposed adjacent turbine wheel 47, as shown in FIG. 1, and is aligned in facing relationship with magnets 94. In operation, pole piece 96 cuts through the magnetic field generated by the rotating magnets 94 and induces a voltage within induction coil 100 formed of about 2,000 turns of wire, such as number 38 magnetic wire, wound about bobbin fixture 93. The magnetic coil of wire around bobbin fixture 93 outputs a small voltage signal of about 2 volts or less through lead wires 102 to activate a light emitter 104, such as a high intensity infrared light emitting diode (IR LED). An exemplary LED, for example, is a Model SFH484 from Siemans Company. IR LED 104 generates flashes of invisible infrared light having a narrow beam which has the ability to be transmitted through semi-translucent materials.

Figure 16:
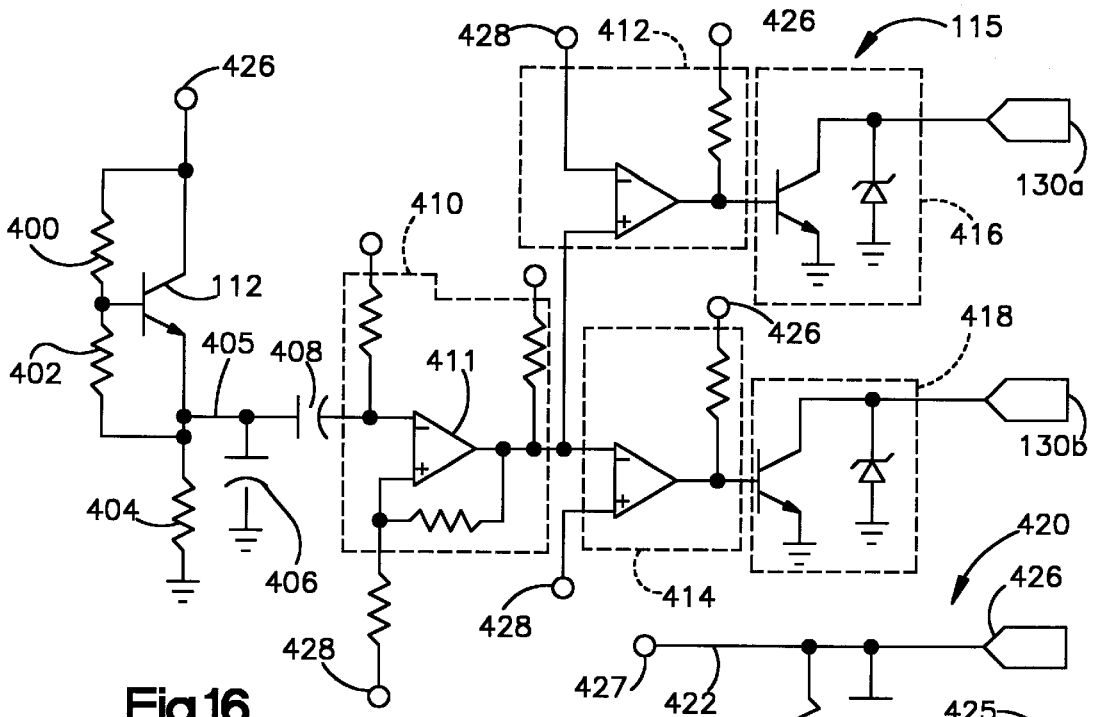
FIG. 16 is a circuit diagram of the speed sensor circuit.

The light from IR LED 104, for example, is transmitted through the forward facing surface 108 of the speed sensor housing 110, which is formed from a translucent material (later described), and into a photo transducer/detector 112 which outputs a low voltage output signal of up to about 2 volts corresponding to the intensity of the IR signal from LED 104. The photo transducer/detector 112, such as a Model SFH303F from Siemans Company, is mounted to a circuit board 114 and outputs the low voltage output signal to an electric circuit 115, as shown in FIG. 16, on circuit board 114.

Electric circuit 115 includes photo transistor 112 with biasing resistors 400 and 402 that bias the transistor 112 such a light signal from LED 104 will generate a DC voltage across photo transistor 112 representative of turbine speed. The DC voltage is condition through capacitors 406 and 408. The signal is then compared to a 6.2V reference by the comparator 411. If the DC voltage amplitude signal in the inverting (negative) input of comparator 411 exceeds the voltage at the non-inverting input (positive), comparator 410 goes to its negative rail and outputs zero volts. Conversely, if the inverting input is less than the non-inverting input, the output of the comparator 410 swings up to the positive rail and outputs a positive voltage, i.e., 12 volts (V). When comparator 410 swings to the negative voltage rail, comparator 412 turns off the output stage 416. Simultaneously, comparator 414, turns on the output stage 418. The net effect at pins **130*a* and 130*b* is a differential TTL voltage output signal. The differential output signal at 130*a* and 130*b* is a square wave signal which varies in frequency proportional to the speed of the turbine. Circuit 115 is designed to output a differential signal, also called a transmission signal, because it is able to travel a long distance and is immune to error caused by distortion from the high voltage of power supply 38**.

In operation, the LED 104 shines a light on and off in a sinusoidal fashion. This resulting sinusoidal light signal varies with the frequency of the turbine wheel 47. The circuit 115 squares the sinusoidal signal and generates a corresponding differential signal output which in turn provides the speed feedback to controller 500. Circuit 115 also includes a power supply 420 having a positive supply rail 422 with a power output 426 and a power voltage output 427 and a reference supply rail 424 with a reference voltage output 428. Power input 426 receives power from a control port (not shown). Power supply also has a ground 425.

The circuit board 114 and photo transducer/detector 112 are enclosed in a conductive sheath 116, particularly in the region of transducer/detector 112. Conductive sheath 116, when suitably grounded to an earth ground (not shown), provides the necessary shielding from high frequency RF signals which otherwise distort the low voltage signal transmitted from transducer/detector 112. Since, however, the circuit board 114 is in the presence of very high voltages, i.e., up to about 100 kilovolts (kv), further isolation of circuit board 114 is necessary to prevent the destruction of the circuitry and any attached controls on board 114. To provide the necessary isolation, both photo transducer/ detector 112 and circuit board 114 are completely encased within the cylindrical casing 118 of speed sensor housing 110. The speed sensor housing 110 is formed of a uniform, seamless, monolithic translucent dielectric material, such as for example, ULTEM 1000 Dielectric, from General Electric Plastics. The casing has a blind bore 120 with the IR LED 104 arranged along a longitudinal axis 122 along with the transducer/detector 112. This spacial relationship enables the IR signal from IR LED 104 to pass through the translucent dielectric material of cylindrical casing 118 and to shine directly onto transducer/detector 112, which in turn generates an output signal that is transferred through wires 113 to circuit board 114. An important aspect of the invention is that the casing 118 is a monolithic structure so that there are no gaps, seams, or discontinuities which would provide a pathway for high static voltage to penetrate into the closed bore 120 and through the conductive sheath 116 to either distort the signal or damage the circuit board 114 and/or the transducer/detector 112. Conductive sheath 116 extends beyond the rear portion of circuit board 114. A cylindrical spacer 126, formed of an electrical insulator, abuts against the open, rear end of conductive shield 116. An electrical fitting 128 is threadably mounted within the opening of casing 118 and abuts against cylindrical spacer 126 to secure conductive sheath 116 in the desired position. An electrical conductor 132, containing lead wires 130*a*, 130*b*, transfers an output differential transmission signal from circuit board 114 to a controller 500.

In operation, as turbine wheel 47 rotates, magnets 94 rotate past pole piece 96 and generate a low voltage signal in response to the magnetic flux from the magnets. The low voltage signal flowing into bobbin 100 creates a voltage signal which activates IR LED 104. An extremely high radiant intensity infrared light then pulses out of the face 106 of IR LED 104 in response to the voltage signal generated in bobbin 100. The infrared light from LED 104 shines through the dielectric material forming the end portion 127 of casing 118 and then into photo transducer/ detector 112. Photo transducer/detector 112, in turn, generates an output signal and transmits the output signal to circuit 115 on circuit board 114 which in turn directs a differential transmission signal through lead wires 130 which extend through electrical fitting 128 and into electrical conductor 132 that is connected to a control device 500. The control device 500 processes the transmission signal, compares it to a reference signal corresponding to a desired rotational speed of turbine wheel 47, and generates an error signal indicating whether the turbine speed is at the desired speed or above or below it. The error signal is then processed by controller 500 to control the drive or brake air pressure applied to turbine wheel 47 and maintains the rotation of wheel 47 at the desired speed. Therefore, the speed control system 64 is produced using optics for isolation but not requiring a long optic link between the rotary atomizer 18 and the control unit 500. Instead a conventional metal wire can be used between atomizer 18 and controller 500 which is not degraded by continual flexing.

EXHAUST AIR

An air exhaust passageway 134 is connected at one end to the interior of turbine wheel housing 45 and at the opposite end to sound mufflers 136. The exhaust of turbine and brake air from turbine wheel housing 45 is directed through passageway 134 and sound mufflers 136 and into enclosed space 20. The exhaust air continues to flow through gap 84 between the large diameter end section 72 and the smaller diameter end section 76 of the outer casing 70 and forward along the outer surface of the casing, as generally shown by arrows in FIG. 1. This flow of exhaust air is effective to prevent paint being sprayed from wrapping back and adhering onto the outer surface of forward section 14 of housing 12 or onto the outer surface of air control element 21. While the exhaust air is effective for preventing the paint from wrapping back and adhering onto the housing, due to variations in the turbine speed and the periodic application of braking air which cause the amount of exhaust air to fluctuate, it is not desirable to use the exhaust air for controlling the shape of the spray emitted from atomizing head 30.

VECTORED AIR

A principal aspect of the invention relates to the provision of vectored air from a source of pressurized air (not shown) through inlet 69 at manifold plate 68. The term "vectored air" means air that has a force and a direction. The vectored air flows through channel 62 and exits, as shown in FIG. 1, directly into a gap 51 between the interface plate 48 and the rear facing cylindrical surface 140 of power supply 38. The vectored air flows around the outer surface 302 of power supply 38 to provide cooling and fresh air circulation there about. Then, the vectored air flows into the enclosed space 142 which surrounds the turbine housing 40 and exhausts through the front surface 24 of forward section 14 into air control element 21. The vectored air is directed through air control element 21, out of throughbore 28, and around atomizing head 30, as discussed hereafter. An important feature of the vectored air is that the flow twists in the same direction about the axis of rotation 34 as the direction of rotation of head 30. This is accomplished by the design of air control element 21, as discussed below.

The vectored air has two primary functions. First, it prevents a vacuum condition around the rear surface of rotary head 30 and thereby eliminates or greatly reduces the wrapback of paint onto the rear portion of rotary head 30. Second, it shapes the paint pattern being expelled from the rotary head 30. This feature eliminates the use of shaping holes for directing air against the paint being expelled from the rotary head, as used in the prior art rotary spray devices. The shaping holes had to be accurately placed and therefore added a significant expense to the manufacture of the rotary atomizer. Also, the shaping holes frequently got plugged with paint and were time consuming to clean.

Referring to FIGS. 1, 4, and 5, the vectored air enters the interior chamber 146 of the annular ring 22 of air control element 21. Annular ring 22 has an outer surface 144 which is tapered inward from the forward section 14 of the atomizer housing 12 to front wall 26 which has a circular throughbore 28. The inner chamber 146 of annular ring 22 has a flow directing section formed of cylindrical wall 148 which is symmetrically disposed about a longitudinal axis 150 through annular ring 22. When annular ring 22 is mounted onto rotary atomizer housing 14, longitudinal axis 150 coincides with the axis of rotation 34 through the rotary atomizer 10. A plurality of ribs 152 are evenly spaced and disposed in parallel relation with axis 150 along the inner surface 154 of cylindrical wall 148. The ribs 152 are sized to engage the outer surface of turbine housing 40 when annular ring 22 is assembled with conventional means, such as screws 156, to the front surface 24 of forward section 14. The open passageways between ribs 152 and turbine housing 40 provide a flow path for the vectored air to flow in the forward direction through circular wall 148.

Annular ring 22 includes air control members 158 formed in circular bore 28 for directing the flow of vectored air around atomizing head 30, as discussed in more detail below. The air control members 158 include a plurality of slots 160 extending outward from the airflow surface 162 of circular bore 28. Each of the slots 160 is spaced from one another and disposed at an angle "b" of about 5° to about 60° with respect to axis 150 to direct flow of vectored air against the surface of atomizing head 30. In a preferred embodiment, slots 160 are disposed at an angle "b" of about 20° to about 45° with respect to axis 150 and most preferably are at an angle of about 37.5° with respect to axis 150. It is also within the terms of the invention, to form the slots 160 with a curvature to direct the flow in a twisting direction about the axis 34 through atomizer 10, as discussed in more detail below.

An important aspect of the invention relates to the provision of the vectored air from a pressurized air supply (not shown), through an air passageway 62, around power supply 38, across ribs 152 and through the slots 160 formed in circular bore 28 of air control element 21. As vectored air exits from circular bore 28, the air flows along the outer flow surface 206 of cup 30 in the same direction as cup 30 is rotating. This substantially eliminates any vacuum condition which might otherwise exist around rotary cup 30 due to effects of the flow of fluid material across atomizing edge 236. The vectored air breaks up the vacuum which would otherwise exist at the rear of head 30 from the air being pulled away due to head rotation. Only a small amount of vectored air is needed to break up this vacuum. The advantage of eliminating this vacuum condition is that the wrap-back of the fluid coating material onto the atomizer housing 12, air control element 21, and head 30 is substantially eliminated. With regard to the design of slots 160, the angle "b" with respect to axis 150 is selected as a function of the speed of rotation of head 130. As the speed is reduced, a shallower angle can be used because less turbulence will be generated by the head. When the speed of head rotation is increased, the angle "b" may also increased to reduce the amount of air turbulence behind head 130. The remainder of the vectored air, which is not required to break up the vacuum, continues to flow along the outer flow surface 206 of head 30 and into the cloud of atomized paint to function as shaping air to control the shape of the cloud or spray pattern being propelled off atomizing edge 236. In operation, the vectored air reduces the diameter of the spray pattern. Thus, a single air source can be used to simultaneously break the vacuum on the back side of the cup and shape the spray pattern.

If, on the other hand, the vectored air is twisted in the opposite direction from the head rotation, a greater degree of turbulence is caused so that the shaping air forms a more ragged, less circular spray pattern. When, the vectored air is simply directed towards the rear of head 30 without any twist, there is still more turbulence than when it is twisted in the same direction as head rotation. In this case, the shaping air still does not provide a spray pattern as smooth and circular as when the vectored air twisted in the direction of head rotation.

CONSTRUCTION OF AIR CONTROL ELEMENT

An important feature of air control element 21 is its construction from a semi-conductive composite material including a low capacitance insulating material and an electrically conducting material and a binder material.

The low capacitance insulating material is a nonconducting, reinforcing material selected to provide desired mechanical properties such as good impact and tensile strength and dimensional stability. Further, the low capacitance insulating material includes the properties of heat, electrical, chemical and mechanical resistance to the reaction with the constituents of the coating material. A preferred type of reinforcing insulating material is glass fiber but other organic or synthetic fibers can be used. The total weight percent of the reinforcing material to the total weight of the composite is about 20 to 40 weight percent and preferably about 25 to 35 weight percent. The weight percent of the reinforcing material can be varied as long as the reinforcing material performs its intended function.

The binder material should possess such properties as good heat and electrical resistance and good chemical and mechanical resistance to the action of the constituents of the coating material. A polymeric material such as PEEK (polyetheretherketone) or PPS (polyphenylene sulfide) is suitable. The total weight percent of the binder material to the total weight of the composite is about 65 weight percent. The weight percent of the binder material can be varied as long as the binder material performs its intended function.

While the electrically conducting material is preferably a carbon containing material, and more particularly a carbon fiber, other electrically conducting materials such as carbon black or particulate graphite can be used. The weight percent of carbon fiber in air control element 21 is selected to provide a desired resistivity, generally equal to that of atomizer head 30. A suitable weight percentage of carbon fiber to the total weight of the composite is about 3 to 15 weight percent, and preferably about 6 to 12 weight percent of the total weight of the composite. Composites containing more than about 15 percent by weight carbon fiber appear to be too conductive, whereas composites containing less than about 3 percent by weight of carbon fiber appear to be too non-conductive.

POWER SUPPLY

Air control element 21 transfers high voltage electrostatic energy from power supply 38 into atomizer head 30. Power supply 38, as shown in FIGS. 17 and 18, is constructed of an arcuate, shaped housing 302 having a throughbore 304 with a convergent section 306 that intercepts a cylindrical section 308. Power supply 38 has an electrical circuit 309 which wraps around arcuate housing 302. Electrical circuit 309 includes an oscillator circuit 310 electrically connected between a low voltage input 312 and a transformer circuit 314. A multiplier circuit 316, constructed from an arcuate shaped capacitor diode chain 318 is connected to the output of transformer 314. Multiplier circuit 316 increases the voltage of the current flowing therethrough and directs the high voltage current into resistor 164.

In operation, a voltage of about 7 volts to about 21 volts is transferred from low voltage input 312 into oscillator circuit 310. The oscillator 310 then outputs an oscillating voltage signal to transformer circuit 314 which in turn outputs an increased voltage signal depending upon the turns ratio of the transformer. The increased voltage signal is input into capacitor diode chain 318 where the voltage is stepped up to about 30,000 kilovolts to 100,000 kilovolts.

While power supply 38 is shown in a ring shaped housing 302 in a rotary atomizer 10, the ring shaped power supply 38 could be used in other liquid and powder electrostatic spray devices as well. The ring shaped power supply is particularly advantageous in electrostatic spray devices which are short in length. That is because substantially all of the components of all of the components of the power supply, and particularly, the capacitor diode chain can be formed into an arcuate shape which lies in a plane perpendicular to the longitudinal axis of the spray device. This is shown in FIG. 17 wherein the multiplier circuit 316 lies substantially entirely in a plane 500 which is perpendicular to axis 34. In previous multiplier design, the capacitor diode chain extends axially along the longitudinal axis of the spray gun which make the spray gun longer.

Figure 19:
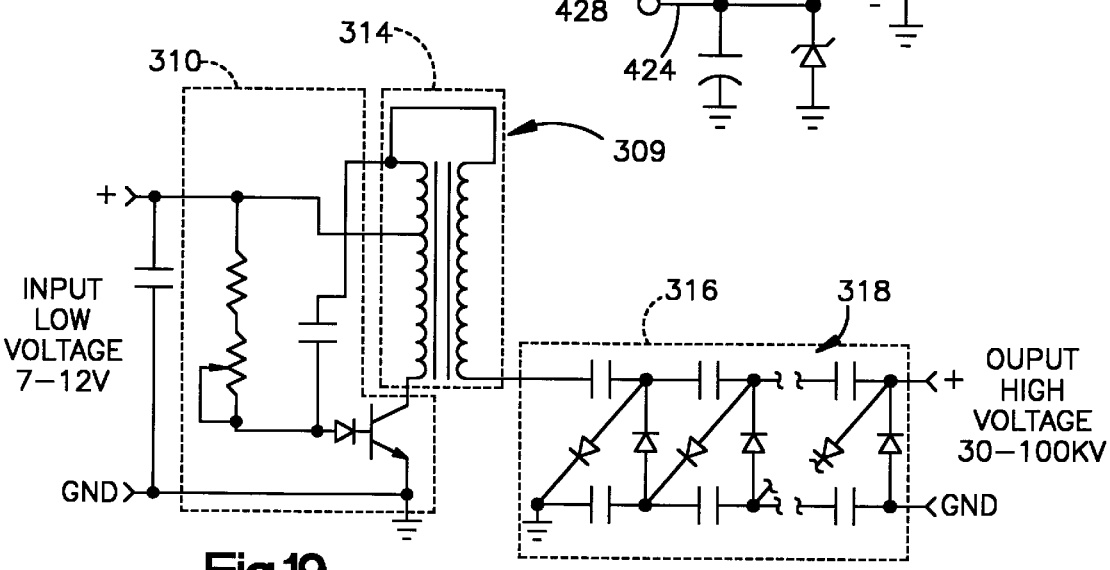
FIG. 19 is a circuit diagram of the power supply circuit.

An important aspect of the invention relates to the provision of an intrinsic safety circuit 350 (shown in FIG. 21) to control the power delivered through electrical conductor 312 (FIG. 19) as the input to power supply 38. Intrinsic safety circuit 350 is located on a circuit board located outside of the coating booth. Conductor 312 runs from circuit 350 which is outside of the booth into the booth to power supply 38 in rotary atomizer 10. Circuit 350 controls the power supplied to power supply 38 through conductor 312 to ensure that no more than a maximum electrical power is present in the electrical components of atomizer 10. This prevents the possibility that an electrical spark could originate from the electrical components within atomizer 10 which would have sufficient energy to ignite volatile paint vapors within the coating booth.

Figure 21:
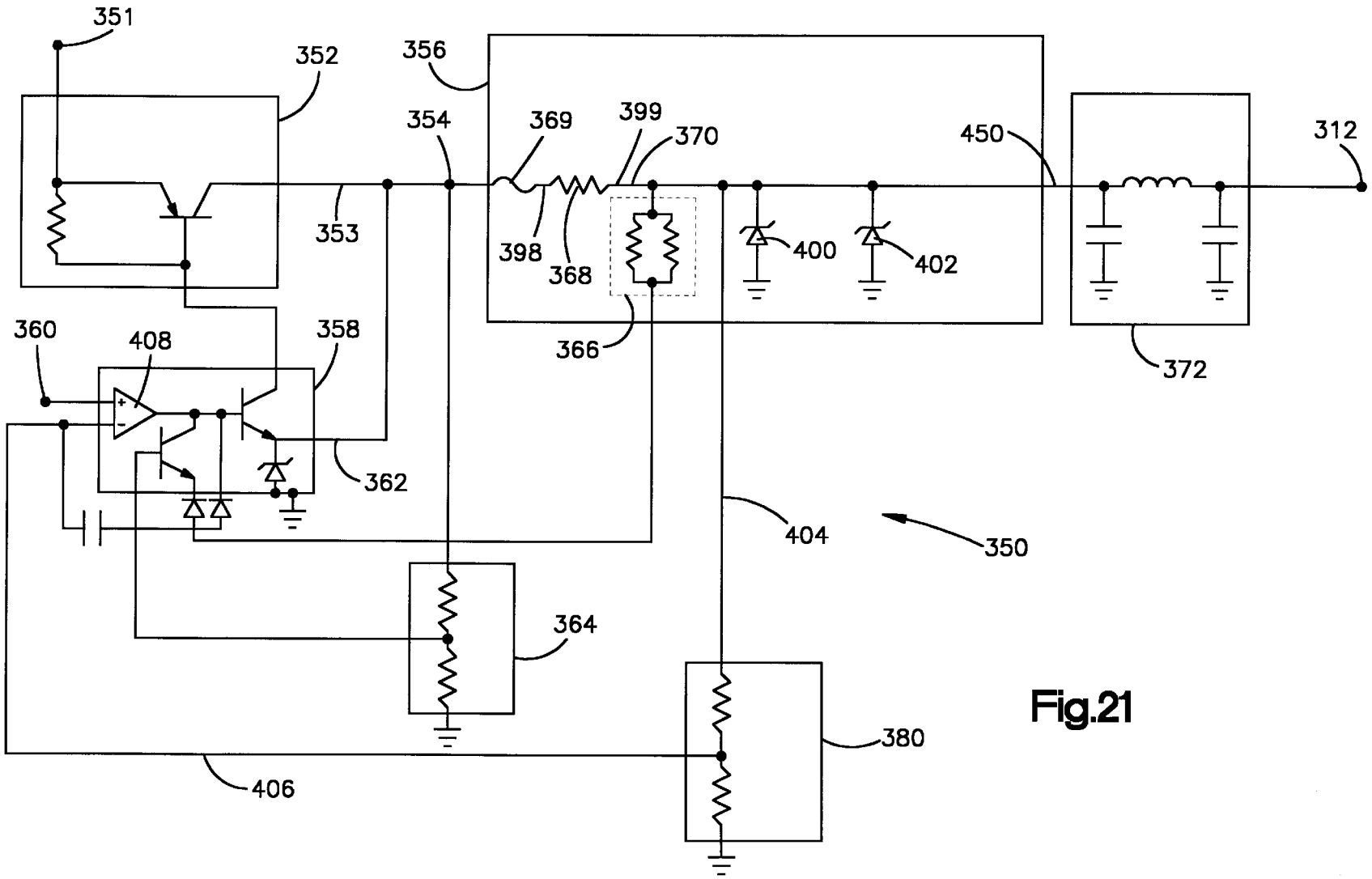
FIG. 21 is a circuit diagram of the intrinsic safety barrier section of the power supply circuit.

Referring to the circuit of FIG. 21, supply voltage input 351 of a pass transistor 352 provides a voltage, such as about 30 V, which is too high to be in the area of the paint spraying for fear of paint mixture ignition. The pass transistor 352 supplies a current through line 353 to the input 354 of an intrinsic safety barrier (ISB) 356. The current passing through line 353 to input 354 of the intrinsic safety barrier 356 is controlled by a voltage regulator 358 and pass transistor 352 because the amount of current "passed" through pass transistor 352 exceeds the current limits of the voltage regulator 358.

The voltage regulator 358 has a control voltage input 360 and is connected by a control line 362 to line 353 which in turn is connected to the input 354 of intrinsic safety barrier 356. Control voltage input 360 is connected to an electronic controller for the system. The function of control voltage input 360 is to control the output of ISB 356 within a 7–21 volt range corresponding to the 30 kv–100 kv output range of power supply 38.

A first feed back section 364 is used in conjunction with a second feed back section 366 to sense the current through a sensing resistor ($R_s$) 368 in line 370 through ISB 356. If the current through resistor 368 exceeds the specified current defined by the resistor values of first feed back section 364, then voltage regulator 358 "folds back" the output current from pass transistor 352 into line 353. If the output at low voltage input 312 of power supply 38 is shorted, the voltage regulator 358 completely "folds back" to limit the shorted output current in line 353 to a safe level, such as for example 45 milliamps (mA).

Sensing resistor 368 functions both as a current sense resistor for voltage regulator 358 and also as the primary resistance of ISB 354. Resistor 368 has an input end 398 and an output end 399. The "fold back" feature of the voltage regulator 358, whereby the output current in line 353 is not permitted to exceed a certain level, is not considered as an infallible device by approval Agencies. Sensing resistor 368, however, is infallible. In prior art intrinsic safety barrier devices, the primary resistance corresponding to sensing resistor 368 is on the order of less than 2 ohms. However in the present invention, where the primary resistance 368 functions as both a current sense resistor for the voltage regulator 358 and also as the primary resistance of ISB 354, $R_s$ 368 has a larger value of about 30 ohms. A fuse 369 is provided to protect resistor 368 in the event too much current is input through line 370. Zenner diodes 400,402 which are connected in parallel to ground, at the output end 399 of sensing resistor 368, and through their respective values limit the maximum amount of voltage that can be present at the output 450 of ISB 356. Second feedback section 366 is preferably located within ISB 356 and has the dual purpose of sensing the voltage at the output end 399 of sensing resistor 368, and limiting the current that can be fed back into voltage regulator 358 or from voltage regulator 358 to the output 450 of ISB 356.

A third feed back section 380 is a voltage sense feedback. Third feed back section 380 is scaled such that 1 to 5 volts on the control input 360 will yield 7 to 21 volts at the output filter 372. For example, if 1 volt is present at control input 360 to comparator 408 of regulator 358, the output voltage at 312 should be 7 volts. Line 404 will input this output voltage into scaled feedback section 380 which will produce a scaled output along line 406 to the comparator 408. The scaled output should be 1 volt for a 7 volt input. If output 406 is less than 1 volt, comparator 408 will drive the regulator 358 to increase its output voltage to drive the voltage at 312 up to 7 volts.

The output filter 372 keeps RF (Radio Frequency) energy from coming from the oscillator circuit 310 of power supply 38 back into ISB 354.

A typical example of regulating the power delivered to power supply 38 with intrinsic safety circuit 350 follows. An input of 1 Volt (V) into the control input 360 of the voltage regulator 358, yields a proportional 7V output from intrinsic safety circuit 350 into input 312 of power supply 38. When 1V is present at the control input 360, and less than 1V is present on line 406, the output of voltage regulator 358 increases to increase the output of pass transistor 352 to output a voltage at the input 354 of ISB 356. Then, third feedback section 380 feeds back the voltage at the output of ISB 356 along line 406 to voltage regulator 358. If the voltage feedback is less than 7V, (i.e. less than 1 volt when scaled down), the output of voltage regulator 358 increases to increase the output voltage of pass transistor 352 such that a higher voltage is present at the input 354 of ISB 356. Then, third feedback section 380 again measures of the output voltage of ISB 356. The feedback control action keeps repeating until the output is at 7V. By placing ISB 356 inside the control loop, the output maintains its regulated value while still providing an intrinsically safe output. Previously, intrinsic safety barriers have not been placed inside feed back control loops of voltage regulators. The advantage of doing this is to be able to deliver a regulated voltage that is intrinsically safe in a hazardous environment. Also, by putting the intrinsic safety barrier within the feed back loop of a voltage regulator, the maximum input voltage necessary for the intrinsic safety barrier to obtain the desired output voltage is less than has previously been the case where the intrinsic safety barrier was not in the feed back loop.

The use of the intrinsic safety barrier design disclosed is of course not limited to its use in supplying power to the power supply of an electrostatic rotary atomizer, but such use is only the presently preferred embodiment.

The high voltage electrostatic energy is transferred from power supply 38 through the air control element 21 via an electrical circuit including a conductor 319 and a resistor 164 mounted on air control element 21, wires 166*a*, 166*b* and 166*c*, resistors 168*a*, 168*b*, 168*c*, and electrodes 174*a*, 174*b*, 174*c*, as shown in FIGS. 4 and 5. Resistors 168*a*, 168*b*, 168*c* are potted with an epoxy material into a channel 170 between cylindrical wall 148 and the inner surface 172 of annular ring 22. Electrodes 174*a*, 174*b*, 174*c* are electrostatic charging and field electrodes projecting from the front surface of wall 26 of air control element 21. The resistors 168*a*, 168*b*, 168*c* lower the spark potential at the electrodes 174*a*, 174*b*, 174*c*, respectively.

The charge in electrodes 174*a*, 174*b*, 174*c* is conducted through air control element 21 which is constructed of a semi-conductive material. Electrodes 174*a*, 174*b* and 174*c* thereby electrically charge element 21. The charge in air control element 21 jumps across the air gap 175 between the circular bore 28 and the atomizing head 30 and then into atomizing head 30, which is secured to the second end 184 of drive shaft 42. The entire atomizing head 30, being constructed of a composite material including a low capacitance insulating material and an electrically conducting material of the type used to construct annular ring 22, is then charged. The same relative proportion of insulative material, conductive material, and binder as used in control element 21 is used in head 30. If an operator were to accidentally touch atomizer head 30 or control element 21, a small electrical discharge, (i.e., a spark) would be provided, but because of the lower spark potential due to the resistors 168*a*, 168*b*, 168*c*, no injury would be sustained. Moreover, if an operator placed a conductor, such as a metal strip, near gap 175 between central bore 28 and the rear surface of head 30, the high electrostatic charge, which would otherwise create a long powerful spark that jumps into the conductor, would dissipate in semi-conductive control element 21 and create a weak discharge and possibly a small spark that would not injure the operator.

DRIVE SHAFT AND FEED TUBE

Motor drive shaft 42, connected at a first end 182 to turbine wheel 47 disposed in the turbine wheel housing 45 of rotary drive mechanism 36, extends forward along axis of rotation 34 to traverse the entire length of rotary drive mechanism 36 so that the opposite second end 184 of drive shaft 42 projects outward through central bore 28 of atomizer housing 12. The second end 184 of drive shaft 42 has a threaded section (not shown) and a frustroconically shaped end adapted to securely attach rotary atomizer head 30. Motor drive shaft 42 has a throughbore 186 which is aligned with axis 34 and extends the length of the drive shaft.

A device for supplying coating material includes a removable coating material feed tube 188 which extends the length of throughbore 186. Tube 188 has a first end 190 which communicates with the interior of atomizer head 30 and which preferably carries a removable nozzle 192. An opposite second end 194 of feed tube 188 is removably mounted to valve 49. When disposed in throughbore 186 of drive shaft 42, feed tube 188 is supported in cantilever fashion free of contact from the interior wall of bore 186, as disclosed in commonly assigned U.S. Pat. No. 5,100,057 ('057) to Wacker et al., which is expressly incorporated herein in its entirety by reference.

ATOMIZER HEAD

A principle aspect of the invention relates to the design of the atomizer head or cup 30 threaded onto the end of rotary drive shaft 42, as illustrated in FIG. 1. The atomizer cup 30, as illustrated in FIG. 6A, has an hour glass like-shape and is uniformly constructed of the composite material including a low capacitance insulating material and an electrically conducting material, as described above with reference to air control element 21.

Figure 6A:
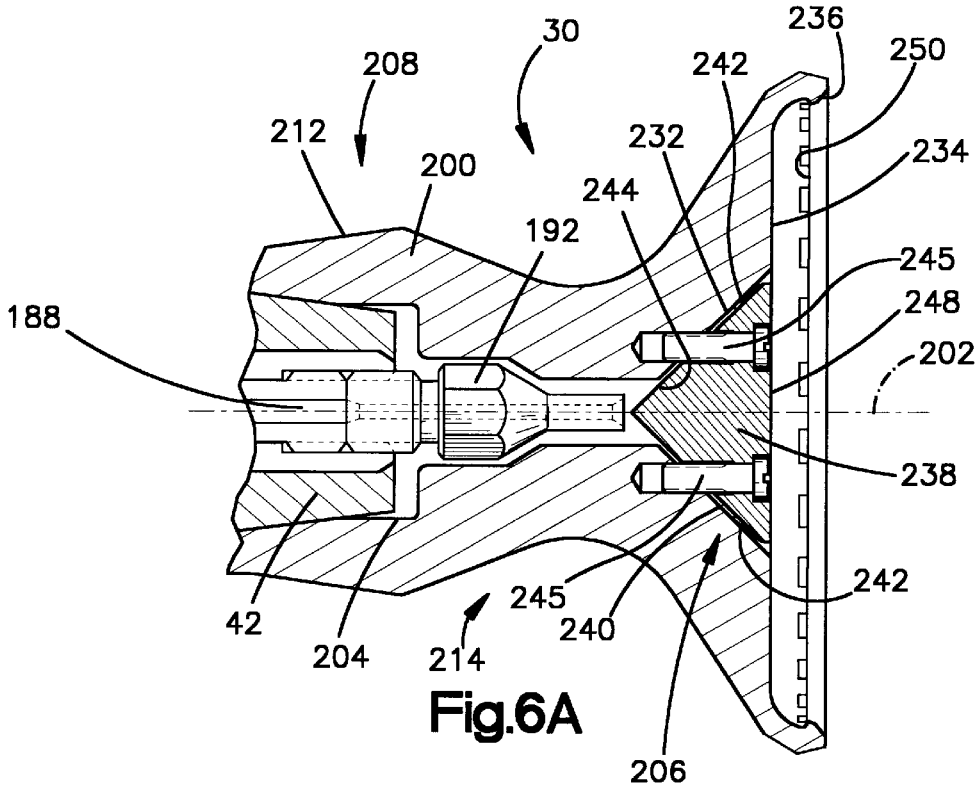
FIG. 6A is a cross sectional side view of a first embodiment of an improved rotary atomizer head having a cone shaped insert for distributing paint onto the front surface of the head.
Figure 6B:
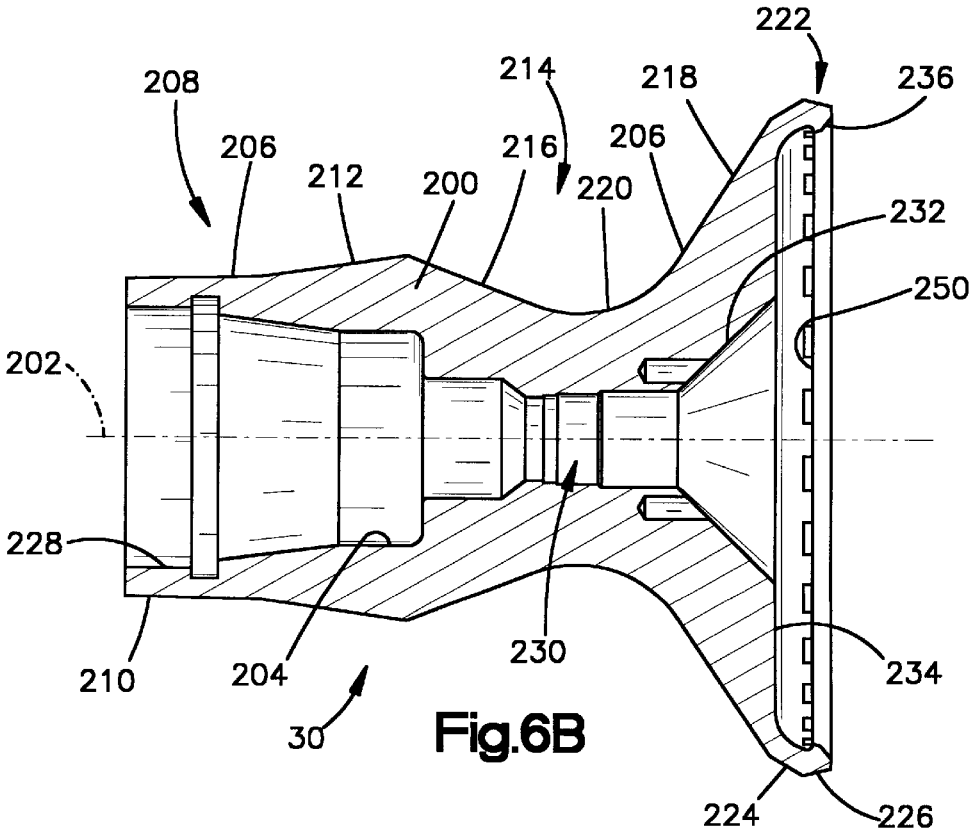
FIG. 6B is a cross sectional side view of the rotary atomizer head prior to the installation of the cone shaped insert.

As seen in FIGS. 6A and 6B, rotary atomizing cup 30 for atomizing coating material is constructed of a rotatable cup body 200 having a hour glass like shape and a longitudinal axis 202 extending therethrough. Longitudinal axis 202 coincides with the axis of rotation 34 through the rotary atomized 10 when cup 30 is mounted onto rotary drive shaft 40 so as to project from annular ring 22. Cup body 200 has an inner flow surface 204 adapted to direct flow of the coating material through cup 30 and an outer surface 206, which in turn, is adapted to direct flow of shaping and vectored air, as described below. Cup body 200 includes a base section 208 symmetrically disposed about the longitudinal axis 202. The outer surface 206, in the vicinity of base section 208, has a cylindrical bottom surface portion 210 and a tapered body surface portion 212 which tapers outward from bottom surface portion 210. An intermediate section 214 of cup body 200, symmetrically disposed about the longitudinal axis 202, includes an outer surface formed of a first portion 216 which is adjoined to the tapered body surface portion 212 and tapers inward, a second surface portion 218 which tapers outward, and a concave intermediate surface portion 220 which extends between the first and second surface portions 216,218, respectively. A generally frustroconically shaped end section 222 is symmetrically disposed about longitudinal axis 202 and has an outer surface 224 which intersects second surface portion 218 of intermediate section 214 and terminates with a beveled edge surface 226.

Turning now to the construction of the inner flow surface 204 of rotatable cup body 200, a mounting portion 228 in the base section 208 is at least partially threaded (not shown) and adapted for mounting cup body 200 onto the free end of rotary drive shaft 42. A nozzle receiving portion 230 in intermediate section 214 adjoins mounting portion 228 and is adapted to receive nozzle 192 extending outward from feed tube 188 which is projecting outward from rotary shaft 42. A distribution receiving portion 231 having a conical surface 232 is symmetrically disposed about longitudinal axis 202 and is adjoined to the nozzle receiving portion 230 at its inner smaller diameter end and to a forward flow surface 234 at its outer larger diameter end. The forward flow surface 234 is located in the frustroconically shaped end section 222 and terminates at an atomizing lip 236. The forward flow surface 234 forms a forward cavity across which charged coating material flows and is propelled radially outward across atomizing lip 236 to form atomized droplets of coating material adapted for application to a workpiece. Since the cup 30 is semiconductive, the coating material becomes charged as it flows in contact with the cup. Therefore, an atomized pattern of changed coating material is produced. The manner in which the paint is atomized by cup 30 is described below. The hour glass-like shape of rotary atomizing cup 30 in combination with the vectored air supply, as described herein, greatly reduces air usage and paint wrap back problems because of a low, i.e., substantially zero, differential pressure condition across atomizing lip 236. This is beneficial because it provides for improved flow pattern control and clean operation, and there is less tendency for paint wrapback. While the improved pattern control results in a more uniform circular cloud of paint, there is still a slight tendency for the paint to wrapback because of the vacuum behind cup 130. The vectored air works together with cup 130 to break up the vacuum and prevent paint wrapback and to shape the paint pattern, by reducing the diameter of the paint cloud.

The rotary atomizing cup 30 further includes a conical insert 238, as seen in FIGS. 6A,7,8, and 9, mounted in spaced relation to conical surface 232 of nozzle receiving portion 230 to define a gap or flow passage 240 therebetween. Gap 240 forms a flow path for coating material flowing from nozzle 192 to forward flow surface 234. A plurality of ribs 242, each extending outwardly from conical surface 244 of insert 238, are spaced from one another to divide the coating material flowing through gap 240 into a plurality of finely divided, individual streams of coating material which are discharged onto the forward flow surface 234. Each of the ribs 242 extend outwardly from the conical surface 244 to abut against the conical surface 232 so that flow of coating material is restricted to the enclosed space formed between conical surface 232 of conical insert 238, conical surface 244 of cup body 200, and adjacent ribs 242. Ribs 242 are preferably spaced a distance of about 0.005 to about 0.020 inches and preferably about 0.010 inches from one another. Ribs 242 are each about 0.010 to about 0.040 inches and preferably about 0.020 inches in width. Ribs 242 each extend a distance of about 0.10 to about 0.30 inches and preferably about 0.15 inches outwardly from the conical flow surface 244. While ribs 242 preferably have a terminal end which is substantially flush with a lip 249 that intersects the forward facing surface 248 of insert 238, it is also within the terms of the invention to place the ribs anywhere along conical surface 244 or alteratively along the conical surface 232 of nozzle receiving portion 230.

The insert 238 is preferably constructed of the same composite material, including a low capacitance insulating material and an electrically conducting material, as the atomizing cup 30. Insert 238 therefore becomes electrically changed by contact with cup 30. This increases the charge on the coating material as it flow through gap 240. Insert 238 is preferably mounted to the cup 30 with electrically conductive screws 245 in throughholes 247. Screws 245 act as field electrodes which increase the amount of the electrostatic field between the cup 30 and the grounded article being painted.

Figure 20:
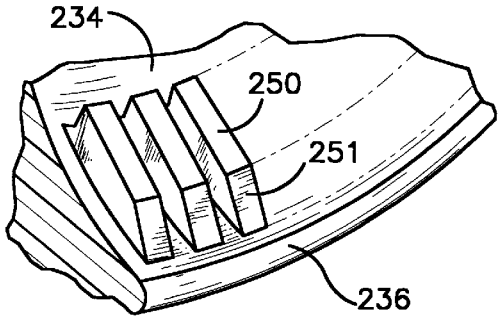
FIG. 20 is an enlarged view of a portion of the rotary head or cup illustrating the radially outwardly extending ribs mounted to the inner surface of the head.

Referring to FIGS. 6A, 6B, and 20, rotary atomizer cup 30 can further include a plurality of second ribs 250, each extending outwardly from the forward flow surface 234. Ribs 250 are spaced from one another to divide the coating material flowing along forward flow surface 234 into a number of individual streams of coating material being discharged from atomizing lip 236 of cup body 200 to form atomized droplets of coating material. Ribs 250 are preferably spaced a distance of about 0.005 to about 0.020 inches and preferably about 0.010 inches from one another. Ribs 250 are each about 0.010 to about 0.040 inches and preferably about 0.020 inches in width. Ribs 250 each extend a distance of about 0.10 to about 0.30 inches and preferably about 0.15 inches outwardly from the conical flow surface 244 of inner flow surface 204. Ribs 250 preferably have a terminal end 251 which is typically spaced up to about 0.010 inches from atomizing lip 236. The advantages of the new design of cup 30 are the two sets of ribs which provide improved atomization because the fluid coating is broken up into thin streams which flow across surface 34. These thin streams of coating are more easily atomized.

The semiconductive insert 238 makes the head 30 easier to clean because it can be easily and quickly removed from head 30 during periodic clean-up. Then, the head and the insert can be soaked in a solvent to remove any paint. Even during paint change, when the head is cleaned by running a solvent therethrough, the conical flow passage 240 between the conical insert 238 and provides a substantially unhindered flow path so that the solvent can properly clean and flush out any paint from head 30.

To commence spraying, the fluid coating material supplied to the feed tube 188 from valve 49 flows through nozzle 192 and into atomizing head 30. The fluid material then flows through gap 240 and across the forward surface 234 of atomizing head 30 just prior to being expelled as droplets from atomizing edge 104 to effect atomization. Throughout the flow of the coating material across the surfaces of head 30, electrostatic charge is imparted to the coating material since the head 30 is electrically changed.

Figure 7:
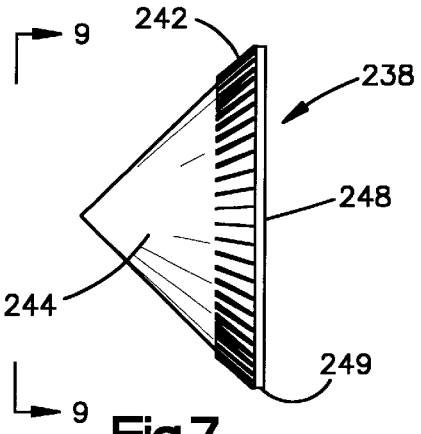
FIG. 7 is a side view of the cone shaped insert shown in FIG. 6A.
Figure 8:
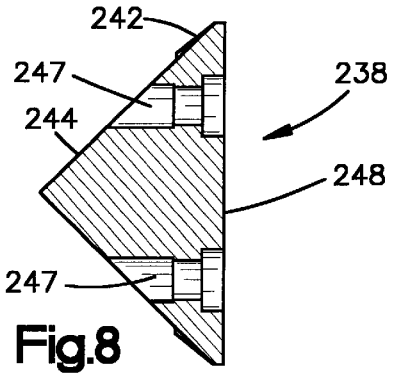
FIG. 8 is a cross sectional view of the cone shaped insert of FIG. 7.
Figure 9:
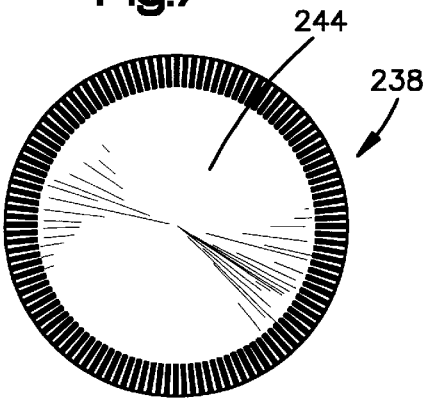
FIG. 9 is a view along line 9—9 of FIG. 7 showing spaced upstanding ribs on the diverging, outward facing sides of cone shaped insert.
Figure 10:
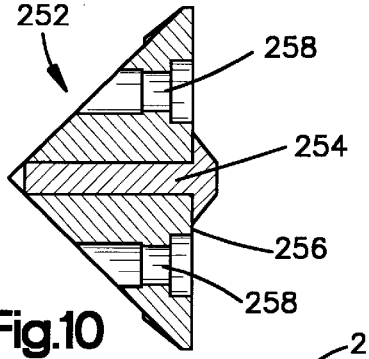
FIG. 10 is side view of a second embodiment of a cone shaped insert having a protruding electrode.
Figure 11:
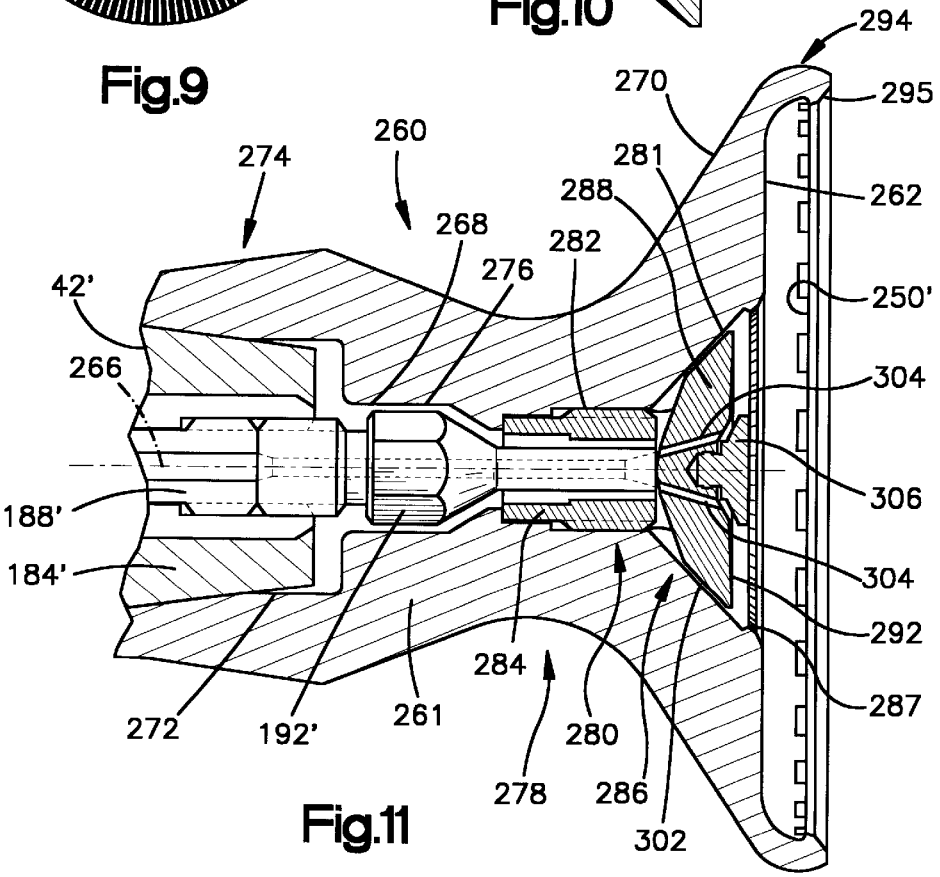
FIG. 11 is a side view of a second embodiment of an hourglass-shaped rotary head, partially in cross section, having a center insert for distributing coating material onto the front surface of the head and maintaining the front surface wet with paint.
Figure 12:
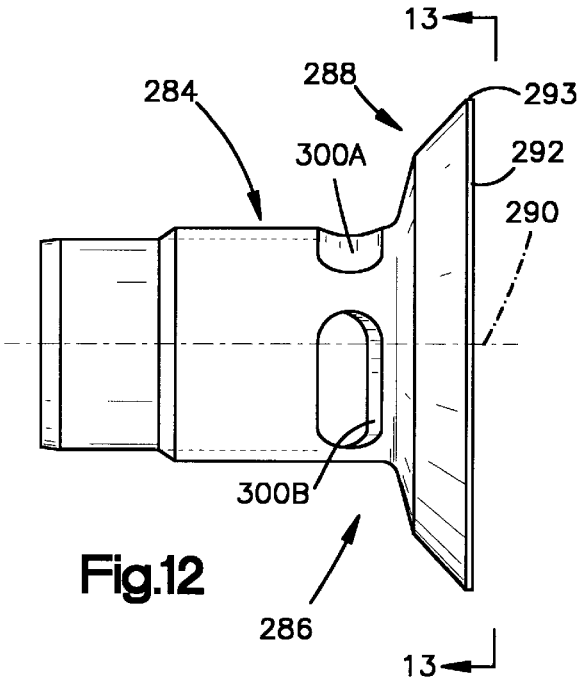
FIG. 12 is a side view of the center insert of FIG. 11.
Figure 13:
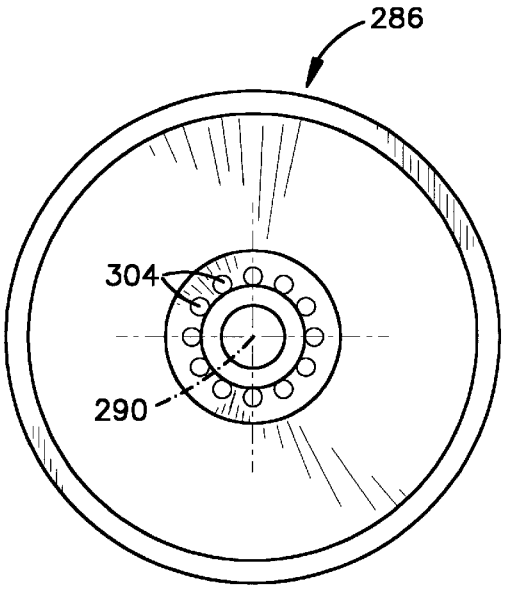
FIG. 13 is a view along line 13—13 of FIG. 12.
Figure 14:
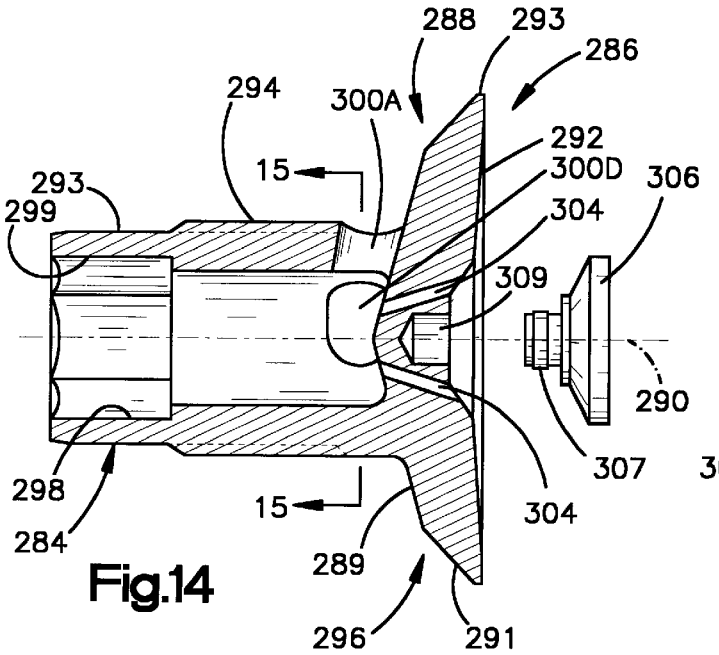
FIG. 14 is a cross sectional view through the insert illustrated in FIG. 12.
Figure 15:
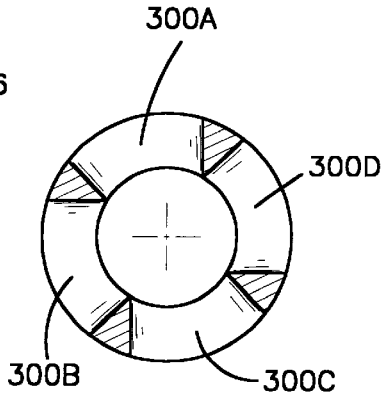
FIG. 15 is a view along line 15—15 of FIG. 14.

While the above described embodiment of the invention provides a very effective means of transferring charge through the rotary cup 30, it is also within the terms of the invention to provide an alternative embodiment wherein an insert 252, as shown in FIG. 10, is adapted to be mounted in cup body 200 in the same manner as insert 238, as shown in FIGS. 6A, 7 and 8. Insert 252 is constructed of a semiconductive material of the type used to construct insert 238 but further includes a metal electrode 254 projecting outward from the center of the front surface 256 of insert 252 to provide a field electrode to increase the strength of the electrode field between the cup 30 and the article being painted. As with insert 238, screw receiving holes 258 are provided to mount the insert to cup 30 with electrically conductive screws (not shown) that further increases the amount of the electrostatic field as previously discussed.

While rotary atomizing cup 30 can be constructed with a conical insert 238, as seen in FIGS. 6A,7,8,and 9, it is also within the terms of the invention to replace cup 30 with an alternative atomizing cup 260, as shown in FIGS. 11, 12, 13, 14, and 15. With cup 260, a portion of the fluid flows through flow channels 304 to wet the front flow surface 292 of a distributor 286 and insure that the entire front flow surface 262 of cup 260 as well as the front flow surface 292 of insert 286 remains in a wetted condition during painting. The reason why this is advantageous to wet the entire front surface of the cup is that paint does not dry on the surface which must be later cleaned with a solvent.

Rotary atomizing cup 260 for atomizing coating material includes a rotatable cup body 261 having a longitudinal axis 266 extending therethrough. Cup body 261 has an inner flow surface 268 to direct flow of the coating material through the cup body and an outer surface 270 to direct flow of shaping and vectored air, as previously described in regard to the atomizing cup 30 of FIG. 6A. Turning now to the construction of the inner flow surface 268 of rotatable cup body 261, a mounting portion 272 in the base section 274 is at least partially threaded and adapted for mounting cup body 261 onto an end of rotary drive shaft 42'. Throughout the specification primed numbers represent structure elements which are substantially identical to structure elements represented by the same unprimed number. A nozzle receiving portion 276 located in an intermediate section 278 is adjoined to mounting portion 272 and encloses nozzle 192 extending outward from feed tube 188. A distributor mounting portion 280, has a first threaded distributor portion 282 adjoined to the nozzle receiving portion 276 and a conical surface 281 symmetrically disposed about longitudinal axis 266. Conical surface 281 is adjoined to distributor 282 at its inner smaller diameter end and to forward flow surface 262 at its outer larger diameter end. The forward flow surface 262 is located in the frustroconically shaped end section 222 and terminates at an atomizing lip 295. The forward flow surface 262 forms a forward cavity across which charged coating material flows and is propelled radially outward across atomizing lip 295 to form atomized droplets of charged coating material adapted for application to a workpiece. The inner flow surface 268 includes a mounting portion 272 in a base end section 274. Mounting portion 272 is at least partially threaded (not shown) and is used for mounting cup body 261 onto an end of a rotary drive shaft 42". A nozzle receiving portion 276, in an intermediate section 278, is adjoined to mounting portion 272. Nozzle receiving portion 276 encloses nozzle 192' which extends outward from feed tube 188.

A plurality of ribs 287, as discussed in more detail below, are disposed at the intersection of conical surface 281 and flow surface 262. Each of the ribs 287 extend inwardly from the conical surface 281 and are spaced from one another to divide the coating material flowing across the intersection of surface 281 and flow surface 262. Ribs 287, which can be constructed in accordance with the geometry of the fins described U.S. Pat. No. 5,078,321, which is hereby incorporated by reference in its entirety, can also be provided at another location on surface 281 or on surface 291 of insert 286. The forward flow surface 262 of cup 260 is located in the frustroconically shaped end section 294 of atomizing head 260 and terminates at an atomizing lip 295. As with the atomizing head 30 of the first embodiment, forward flow surface 262 forms a forward cavity across which charged coating material flows outwardly and is propelled radially outward from atomizing lip 295 to form atomized particles of charged coating material adapted for application to a workpiece. A plurality of second ribs 250', each extending outwardly from the forward flow surface 262, can be provided as discussed with respect to cup 30.

As shown in FIGS. 11–15, a distributor 286 is inserted within distributor mounting portion 280 and spaced from conical surface 281 to form a gap 302 therebetween. The cylindrically shaped rear section 284 of distributor 286 has a cylindrically-shaped rearward portion 293 and a threaded, cylindrically-shaped, forward portion 294, with a slightly larger diameter. Distributor 286 also has a frustroconically shaped forward section 288. The frustroconically shaped section 288 has a first frustroconical surface 289 which intersects the forward distributor portion 294, a second frustroconical surface 291 which intersects frustroconical surface 289 and a lip 293. The distributor 286 is mounted in atomizer cup 260 so that longitudinal axis 266 of the cup is coincident with the longitudinal axis 290 through distributor 286. Distributor 286 is assembled into cup 260 so that cylindrically shaped rearward portion 284 is threaded into the first threaded distributor portion 282 and frustroconically shaped forward section 296 is disposed in the conically shaped portion 281 to form a narrow gap 302 therebetween which forms a flow path for coating material flowing from the nozzle 192' to the forward flow surface 262 of atomizing head 260. The flow of coating material is split up into a plurality of flow patterns by the narrow ribs 287.

Distributor 286 is installed in cone cup mounting portion 280 by inserting rear section 284 into distributor mounting portion 280 from the side of front flow surface 262. Then, an allen wrench is inserted into a hexagonal-shaped entrance section 299 of distributor 286 and the latter is turned counterclockwise to thread forward portion 294 into threaded distributor portion 282. The threads are left handed so that distributor 286 won't have a tendency to loosen as head 260 spins in the clockwise direction. The feature of being able to easily and quickly insert and remove distributor 286 from cup body 261 is advantageous during periodic cleaning of the head 260.

Distributor 286 further includes an inlet bore 298 adapted to receive the outlet end of nozzle 192'. One or more coating material passageways 300A, 300B, 300C, 300D (300A–300D), are disposed diametrically across distributor 286 between the intersection of cylindrically shaped rear section 284 and frustro-conically shaped forward portion 296. Passageways 300A–300D are provided to direct coating material from inlet bore 298 to the gap 302 between conically shaped forward section 296 and conically shaped portion 281. The coating material is divided into streams as it flows across ribs 287 and onto forward flow surface 262 from which it is propelled off of the atomizing lip 295, as previously described.

Distributor 286 also includes structure to insure that its forward face 292 remains wet during operation so that the cup insert can be quickly cleaned. If forward face 292 were not wetted then, the paint would dry and cleaning would be a difficult, time-consuming process. A plurality of wetting passageways 304 through distributor 286 direct streams of liquid coating material from inlet bore 298 to forward flow surface 292 of distributor 286 to keep forward flow surface 292 wet during the operation of rotary atomizer cup 260.

Distributor 286 also incorporates a deflector 306 mounted on forward flow surface 292 in spaced relation thereto and opposite wetting passageways 304 whereby coating material flowing through wetting passageways 304 impacts against deflector 306 and spreads outward along forward flow surface 292. The deflector 306 has a stem 307 which is frictionally secured within a closed bore 309. Frictional securement is achieved by a slight interference fit between the plastic material of the deflector 306 and distributor 286. Deflector 306 can be easily removed and cleaned during shutdown or color change by simply pulling it out of bore 309.

During operation of atomizer head 260, the majority of the flow of coating material is forced through passageways 300A–300D and into gap 302 due to centrifugal force. The stream of coating material flows through gap 302 and onto the front flow surface 262. Then the coating material flows across flow surface 262 just prior to being propelled from atomizing edge 295 to effect atomization. At the same time, the remainder of the coating material flowing from inlet bore 298 flows through wetting passageways 304 and is deflected by deflector 306 back onto forward flow surface 292 to keep the latter flow surface wet during operation. After flowing across surface 292, the coating material merges with the flow of coating material through gap 302. Throughout the contact of the coating material with the surfaces of atomizer head 260, electrostatic charge is imparted to the coating material since the head 260 is charged.

MODIFIED ROTARY ATOMIZER

Figure 22:
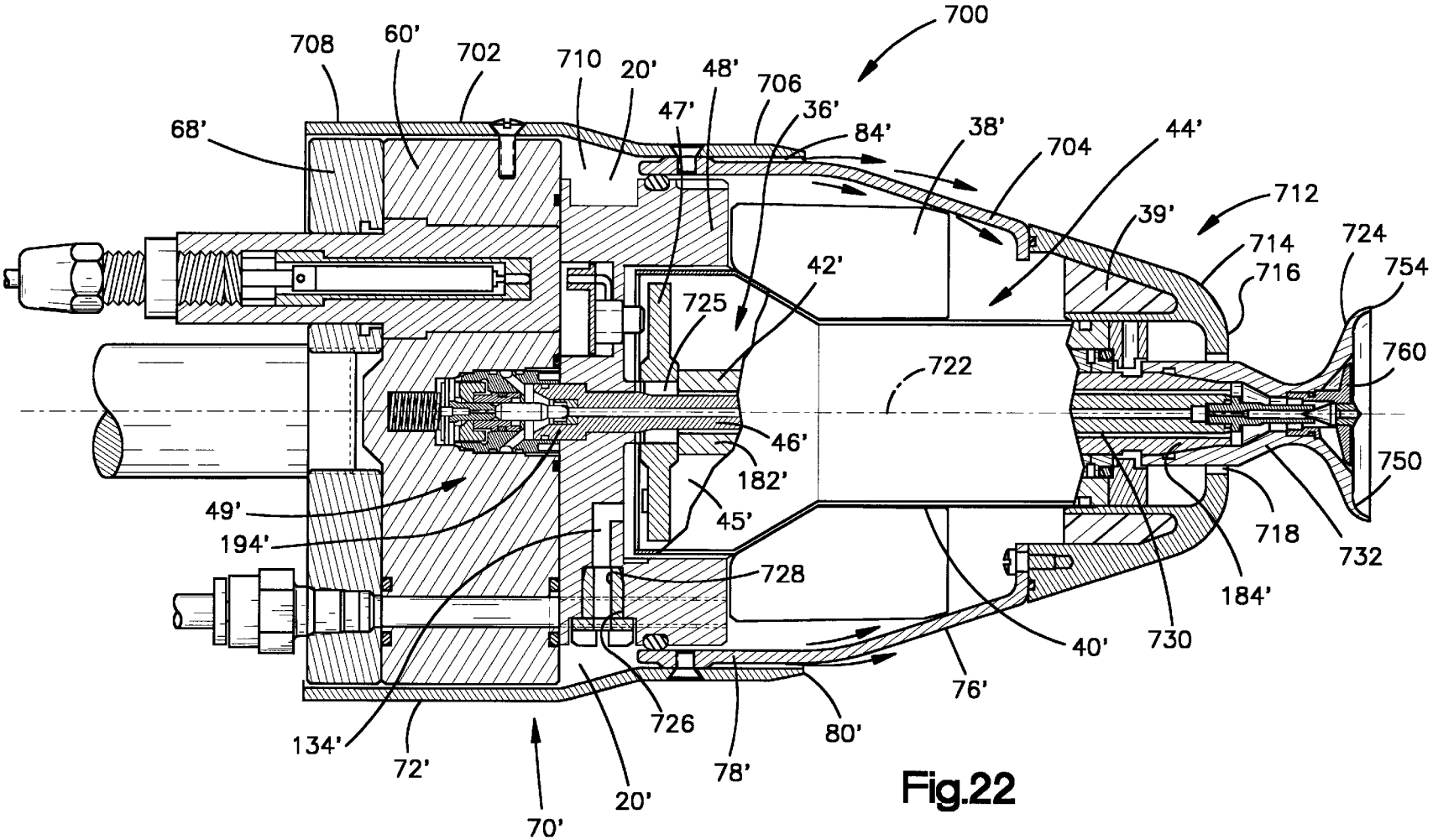
FIG. 22 is a cross sectional side view of another embodiment of a rotary atomizer wherein a portion of the exhaust air from the air turbine motor is channeled into the atomizer head to mix with the coating material and prevent the coating material from leaking back into the rotary atomizer device.

Referring to FIG. 22, there is illustrated an electrostatic, liquid spray, rotary atomizer 700, which is very similar to the construction of atomizer 10 but with certain modifications in accordance with an additional embodiment of the invention. The rotary atomizer 700 includes an atomizer housing 702 having a forward section 704, an intermediate section 706, and a rear section 708 which collectively define an interior chamber 710.

An air control element 712, incorporating an annular ring 714 as shown in detail in FIG. 22, is detachably mounted to the forward section 704. Annular ring 714 has a front wall 716 provided with a circular bore 718 that is coincident with a longitudinal axis of rotation 722 that extends through atomizer housing 700.

An internal power supply 38', located within interior chamber 710, generates high voltage electrostatic energy in the range of from about 30,000 volts DC to about 100,000 volts DC. Power supply 38' is electrically connected to air control element 712 by electrical voltage transfer structure 39', as previously described, and schematically illustrated herein.

Rotary drive mechanism 36', located within the interior chamber 710 of rotary atomizer 700, is preferably an air driven type turbine motor 44' which includes internal air bearings (not shown), a driving air inlet (not shown), and a braking air inlet (not shown) for controlling the rotational speed of a turbine wheel 47', all of which components are well known in the art. Turbine motor 44' includes a rotary drive shaft 42' that extends through and is rotatably supported within a turbine housing 40'. Rotary drive shaft 42' extends through circular bore 718 of annular ring 714 and has an atomizer cup or head 724 mounted at one end. Drive shaft 42' further extends into a turbine drive wheel housing 45' at the opposite end and is connected to turbine wheel 47'.

A stationary, liquid flow tube 46' extends completely through rotary drive mechanism 36', and is in fluid communication with an air operated valve 49' at one end and atomizing head 724 at the opposite end for transferring a liquid coating from the valve 49' to the atomizing head 724.

Referring to air turbine motor 44', a source of pressurized turbine drive air is connected by a passageway (not shown) through manifold plate 68' and valve plate 60' to the turbine wheel housing 45' to spin air turbine drive wheel 47' according to conventional practice. That is, the stream of turbine drive air is directed against the outer perimeter of drive wheel 47' to rotate the wheel about the longitudinal axis 722 extending through rotary atomizer 700. A source of brake air is also connected by a passageway (not shown)

through manifold plate 68' and valve plate 60' to the turbine wheel housing 45' for application against upstanding brake buckets (not shown) projecting from the side face of turbine wheel 47'.

The atomizer housing 700, as shown in FIG. 22, includes an outer casing 70' with a larger diameter rear end section 72' enclosing manifold plate 68', valve plate 60', and interface plate 48'. Outer casing 70' also includes a tapered front end section 76' which has a cylindrical, rear end portion 78' received within the open front end 80' of the rear end section 72' of outer casing 70'. An air gap 84', as shown in FIG. 22, formed by the spacing between the large diameter front end 80' of rear end section 72' and the smaller diameter cylindrical rear end portion 78' of front end section 76', provides an exhaust path for a portion of the air exhausted from the turbine wheel housing 45', as discussed in more detail below.

DRIVE SHAFT AND FEED TUBE

The hollow motor drive shaft 42', connected at a first end 182' to turbine wheel 47' disposed in the turbine wheel housing 45' of rotary drive mechanism 36', extends forward along axis of rotation 722 to traverse the entire length of rotary drive mechanism 36' so that the opposite second end 184' of drive shaft 42' projects outward through circular bore 718 of atomizer housing 702. The second end 184' of drive shaft 42' has a threaded section (not shown) and a frustroconically shaped end adapted to securely attach rotary atomizer head 724. Motor drive shaft 42' has a throughbore 186' which is aligned with axis of rotation 722 and extends the length of the drive shaft.

A device for supplying coating material includes a removable coating material feed tube 46' which extends the length of throughbore 186'. Tube 46' has a first end 190' which communicates with the interior of atomizer head 724 and which preferably carries a removable nozzle 192'. An opposite second end 194' of feed tube 46' is removably mounted to valve 49', as generally shown in FIG. 22. When disposed in throughbore 186' of drive shaft 42', feed tube 46' is supported in cantilever fashion free of contact from the interior wall of bore 186', as disclosed in the U.S. Pat. No. 5,100,057 patent, to form the cylindrically shaped air passage 730.

EXHAUST AIR

An air exhaust passageway 134' is connected at one end to the interior of turbine wheel housing 45' and has a restrictor plug 726 at the opposite end. While a single air exhaust passageway 134' is illustrated, it is within the scope of the invnetion to provide a plurality of spaced exhaust passageways, each containing a restrictor plug 726, as desired. Restrictor plug 726 has a central throughbore 728 extending therethrough. A portion of the exhaust of turbine and brake air from turbine wheel housing 451 is directed through passageway 134' and restrictor plug 726 and into enclosed space 20'. This portion of the exhaust air continues to flow through gap 84' between the large diameter end section 72' and the smaller diameter end section 76' of the outer casing 70' and then flows forward along the outer surface of the casing, as generally shown by arrows in FIG. 22. This flow of a portion of the exhaust air is effective to prevent paint being sprayed from wrapping back and adhering onto the outer surface of forward section 76' of housing 702 or onto the outer surface of air control element 714.

The portion of the exhaust of turbine and brake air from turbine wheel housing 45' which is not directed through 84' is directed through passageway 725 of turbine wheel 47', as seen in FIG. 22, and into air passageway 730. The airflow enters the passage 727 within the atomizer head 724 and functions to mix with the flow of liquid coating material within the atomizer head to improve the dispersion of the liquid coating material from the atomizer head and to keep the head cleaner. Also, the air flow through the atomizer head 724 increases the flow rate of flushing fluid that can be forced through the head which reduces the down time for cleaning the rotary atomizer 700. Another important aspect of the invention is that the flow of exhaust air through the air passageway 730 creates an air barrier that prevents the liquid coating material being dispensed by the atomizer head from leaking back into the cylindrically shaped air passage 730 and then migrating into the rotary atomizer device and causing premature mechanical failure, such as fouled bearings. While the exhaust of turbine and brake air from turbine wheel housing 45' is effective to accomplish the advantages of the present invention, it is also within the terms of the invention to provide a separate source of air for delivery through the atomizer head 724.

While the air passage 730 has been present in prior art atomizers, the turbine exhaust air has not been forced to flow down passage 730 and through the atomizer head because of the presence of the exhaust opening 134'which formed a relatively unrestricted path for the air to flow out of the housing. The restrictor plug 726, previously described, forces the air through passsage 730 and through the atomizing head 724 to achieve the benefits described herein.

ATOMIZER HEAD

Figure 23:
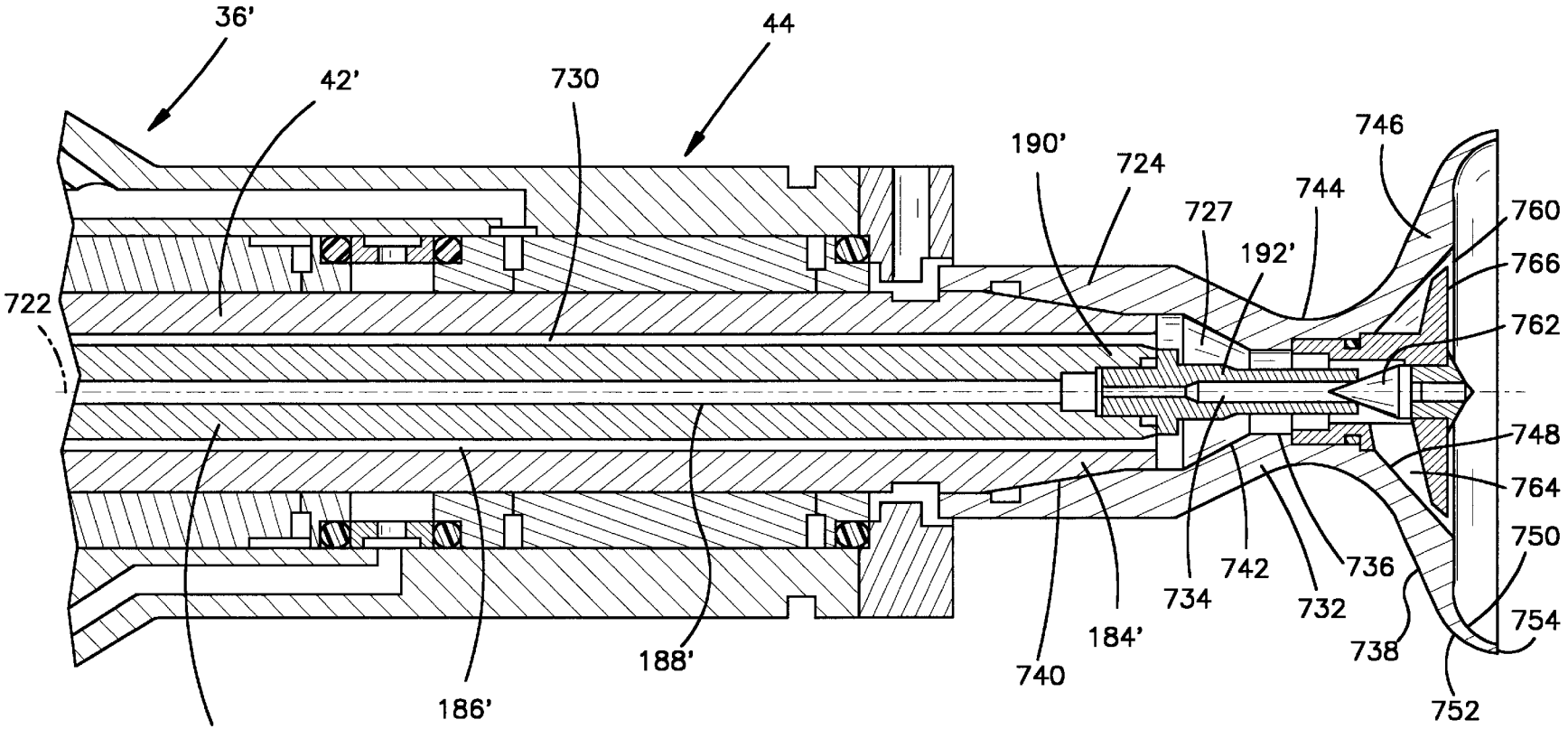
FIG. 23 is an enlarged partial sectional view of the rotary drive shaft assembled together with the atomizer head.

An aspect of the embodiment of the invention relating to the provision of exhaust air to the atomizer head or cup 724 relates to the assembly of the head or cup 724 onto the end of rotary drive shaft 42, as illustrated in FIGS. 22 and 23. The atomizer cup 724, as illustrated in FIGS. 22 and 23, has an hour glass like-shape and maybe uniformly constructed of the composite material including a low capacitance insulating material and an electrically conducting material, as described above with reference to air control element 21 hereinbefore. Alternatively, the cup may be molded from insulative and conductive materials as shown in prior U.S. Pat. No. B1 4,887,770, which is hereby incorporated by reference in its entirety.

As seen in FIGS. 22 and 23, rotary atomizing cup 724 for atomizing coating material is constructed of a rotatable cup body 732 having a hour glass like shape and a longitudinal axis 734 extending therethrough which coincides with the axis of rotation 722 through the rotary atomizer 700 when cup 732 is mounted onto rotary drive shaft 42' so as to project outward from annular ring 714. Cup body 732 has an inner flow surface 736 adapted to direct flow of the liquid coating material through cup 732 and an outer surface 738, which in turn, is adapted to direct flow of shaping and vectored air, as described before.

Turning now to the construction of the inner flow surface 736 of rotatable cup body 732, the base section 740 is adapted for mounting the cup body onto the free end of rotary drive shaft 42', by conventional means such as with a threaded connection. A nozzle receiving portion 742 in an intermediate section 744 is adapted to receive nozzle 192' extending outward from feed tube 188' which in turn is projecting outward from rotary shaft 42'. A distribution receiving portion 746 having a conical surface 748 is symmetrically disposed about longitudinal axis 734 and is adjoined to the nozzle receiving portion 742 at its inner smaller diameter end and to a forward flow surface 750 at its outer larger diameter end. The forward flow surface 750 is located in the frustroconically shaped end section 752 and terminates at an atomizing lip 754. The forward flow surface 750 forms a forward cavity across which charged coating material flows and is propelled radially outward across atomizing lip 754 to form atomized droplets of coating material adapted for application to a workpiece. Since the cup 724 is semiconductive or has conductive portions, the coating material becomes charged as it flows in contact with the cup. Therefore, an atomized pattern of charged coating material is produced. The manner in which the paint is atomized by cup 724 is generally described before. The hour glass-like shape of rotary atomizing cup 724 in combination with the vectored air supply, as described hereinbefore, greatly reduces air usage and paint wrap back problems because of a low, i.e., substantially zero, differential pressure condition across atomizing lip 754. This is beneficial because it provides for improved flow pattern control and clean operation, and there is less tendency for paint wrapback, especially when the system is used in combination with the vectored air, as previously described.

The rotary atomizing cup 724 further includes a distributor 760 with a conical insert 762, as seen in FIGS. 22 and 23, mounted in the inner flow surface 736. The end of the conical insert 762 is disposed in the outlet end of the nozzle 192' and in spaced relation thereto to allow the coating material to flow into the flow passage 764 between the conical surface 748 and the end 766 of the distributor so that the coating material is forced to flow across flow surface 750 and then across the atomizer lip 754. The distributor 760 also directs the air flowing from air passageway 730 into chamber 727 between the inner flow surface 736 and the nozzle 192' into the flow passage 764 where the air mixes with the coating material before flow across flow surface 750 and then across the atomizer lip 754.

In the operation of the electrostatic spray device, a flow of the liquid coating material is directed through a fluid tube 46' extending through and disposed within the rotary drive shaft 42'. The rotary drive shaft is rotated by the air turbine motor 36' which simultaneously rotates the atomizer head 724. A first portion of the exhaust air from the air turbine motor 36' is directed through the cylindrically shaped air passage 730 and into the atomizer head 724 to create an air barrier within air passage 730 that prevents the liquid coating material being dispensed by the atomizer head from flowing back into air passage 730. The first portion of the air also serves to mix with the coating material within the atomizer head to improve the delivery of the atomized coating material. A second portion of the exhaust air from the air turbine motor flows through the plug 726 from the atomizer housing along an outer surface 76' of the front end section 704 of the atomizer housing 702.

It is apparent that there has been provided in accordance with this invention an apparatus and method that satisfies the objects, means and advantages set forth hereinbefore. A rotary atomizer has an internal power supply in the atomizer housing about which is passed cooling air. The air then flows out of the atomizer housing in a twisting direction as vectored air in the same direction of rotation as the atomizer head to eliminate any vacuum condition around the atomizer head and to provide shaping control of the coating being sprayed. Exhaust air from an air turbine motor driving the atomizer head is directed around the outside surface of the atomizer housing to prevent the liquid coating from wrapping back and accumulating onto the atomizer housing. A speed sensing system is mounted in the atomizer housing and utilizes both magnetics and optics for accurately measuring the rotational speed of the air turbine motor in the presence of high electrostatic charge and RF fields from the internal power supply. The power supply is disposed within the atomizer housing about the turbine motor. The atomizing head, in one embodiment, incorporates an insert which divides the flow of coating material into a plurality of individual streams to improve the atomization of the coating material from the atomizing head. In another embodiment, an insert is located in the atomizing head to insure that the front flow surface of the atomizer head remains wet during operation so that the atomizing head is easier to clean. The power supply is ring shaped and encircles the turbine and the paint flow passage through the turbine. An intrinsic safety barrier is provided to supply electrical power to the power supply. The intrinsic safety barrier is incorporated into the feedback loop of a voltage regulator. In another embodiment, a portion of the exhaust air from an air turbine motor is directed to the atomizing head to create an air barrier that prevents coating material from leaking back into the rotary atomizer device and causing premature mechanical failure. The airflow also is mixed with the coating material in the atomizing head to improve the dispersion of the liquid coating material from the atomizer head and to keep the head cleaner.

While the invention has been described in combination with embodiments thereof, it is evident that many alternatives, modifications, and variations will be apparent to those skilled in the art in light of the foregoing description. Accordingly, the invention is intended to embrace all such alternatives, modifications and variations as fall within the spirit and scope of the appended claims.

We claim:

1. An electrostatic rotary atomizing spray device for spraying a liquid coating material, comprising:

an atomizer housing which defines an interior chamber therein;

a motor within the atomizer housing that produces an exhaust airflow and is connected to a rotary atomizer head; and an air passageway within the atomizer housing for directing at least a portion of the exhaust airflow from the motor into the interior of the atomizer head.

2. The electrostatic rotary atomizing spray device of claim 1 further comprising:

a drive shaft within the interior chamber of the atomizer housing, the drive shaft being attached at a first end to the motor and at a second opposite end to the rotary atomizer head; and a fluid tube being disposed within the drive shaft and spaced therefrom by an air passage, the fluid tube for directing a flow of the liquid coating material to the atomizer head, and wherein the motor is an air turbine motor and the air passageway directs a first portion of the exhaust airflow from the air turbine motor into the air passage to create an air barrier and then into the atomizer head, and a second portion of the exhaust airflow to a location external to the atomizer housing.

3. The electrostatic rotary atomizing spray device of claim 2 wherein the air passageway includes a flow restrictor through which flows the second portion of the exhaust air to the location external to the atomizer housing.

4. The electrostatic rotary atomizing spray device of claim 3 wherein the atomizer housing has an outer casing having a rear end section with an open front end, and a front end section mounted within the open front end of the rear end section to form an air gap through which the second portion of the exhaust air flows out from the atomizer housing and along an outer surface of the front end section of the atomizer housing.

5. The electrostatic rotary atomizing spray device of claim 4 further comprising:

the rotary atomizer head having a bore extending therethrough; and a flow distributor mounted in the bore of the rotary atomizer head, the flow distributor having a first flow passage to direct the flow of the coating material from the fluid tube to a forward flow surface of the rotary atomizer head, the flow distributor having a second flow passage to direct the flow of exhaust air from the air passage to the first flow passage to mix with the coating material as it flows to the forward flow surface of the rotary atomizer head.

6. The electrostatic rotary atomizing spray device of claim 3 wherein the flow restrictor is sized for about 75% to about 85% of the exhaust air to flow to the location external to the atomizer housing and the remainder into the air passage.

7. The electrostatic rotary atomizing spray device of claim 1 wherein said motor is a turbine motor including a turbine wheel in a turbine wheel housing, said turbine wheel arranged with at least one permanent magnet affixed thereto to rotate concentrically about an axis of rotation extending longitudinally through said atomizer housing, said electrostatic rotary atomizing spray device further comprising a speed monitoring device comprising:

a speed pickup portion mounted within said atomizer housing, said pickup portion including a pole piece arranged with a first end terminating adjacent to but free from contact with said at least one permanent magnet and an induction coil disposed about said pole piece for producing an output signal representing the rotational speed of said turbine wheel;

a light emitting device receiving said output signal from said induction coil for outputting a light signal representing said rotational speed of said turbine wheel;

a photo transducer/detector mounted within said atomizer housing relative to said light emitting device to generate an output signal in response to said light signal from said light emitting device;

an electric circuit for processing said output signal to produce a transmission signal; and an electrical conductor for transmitting said transmission signal from said atomizer housing to a control device for said air turbine motor.

8. The electrostatic rotary atomizing spray device of claim 1 wherein said rotary atomizer head for atomizing coating material comprises:

a rotatable head body having a longitudinal axis therethrough and formed with an inner flow surface for directing flow of said coating material across said inner flow surface; and an insert aligned coaxially with said longitudinal axis and mounted in said head body to define a gap therebetween which forms a flow path for said flow of coating material from said nozzle to a forward flow surface of said head body.

9. The electrostatic rotary atomizing spray device of claim 1 wherein said rotary atomizer head for atomizing coating material comprises:

a head body having a longitudinal axis therethrough and formed with an inner flow surface to direct flow of said coating material across said inner flow surface, said head body including:

a mounting portion in base section for mounting said atomizing head onto an end of a rotary drive shaft;

a nozzle receiving portion in an intermediate section adjoined to said mounting portion to receive a nozzle extending outward from a feed tube projecting from an end of said rotary drive shaft; and a distributor mounting portion adjoined to said nozzle receiving portion to receive a distributor;

said inner flow surface having a forward flow surface terminating at an atomizing lip, said forward flow surface forming a forward cavity across which coating material is propelled radially outward to form atomized droplets of coating material; and said distributor having a cylindrically shaped rear section and a frustro-conically shaped forward section, said distribution being aligned with said longitudinal axis and mounted in said atomizing head body so that said frustro-conically shaped forward section is disposed in said head body to define a gap therebetween to form a flow path for said flow of coating material from said nozzle to said forward flow surface.

10. The electrostatic rotary atomizing spray device of claim 1 further comprising an intrinsic safety circuit to output a regulated intrinsically safe voltage, which comprises:

an intrinsic safety barrier device carrying a current from an input, through a sense resistor having an input end and an output end, and to an output from which a regulated intrinsically safe voltage is being output;

a pass transistor outputting said current to said input of said intrinsic safety barrier device; and a voltage regulator having a first input with a control voltage, a second input connected through a first feedback loop to said output end of said sense resistor, and an output connected to an input of said pass transistor.

11. The electrostatic rotary atomizing spray device of claim 1 further comprising a voltage regulating circuit, comprising:

a voltage regulator having an output;

an intrinsic safety barrier having an input and an output and a sensing resistor between said input and said output, said sensing resistor having an input end and an output end, said output of said voltage regulator being connected to said input; and a first feedback loop connected between said output end of said sensing resistor and a first input of said voltage regulator.

12. The electrostatic rotary atomizing spray device of claim 1 further comprising:

a power supply having an input and an output, said output of said power supply being connected to charging elements in said spray device to electrically charge said coating material; and a voltage regulating circuit remote from said electrostatic spray device, said voltage regulating circuit comprising:

a voltage regulator having an output;

an intrinsic safety barrier having an input and an output and a sensing resistor between said input and said output, said sensing resistor having an input end and an output end, said output of said voltage regulator being connected to said input; and a first feedback loop connected between said output end of said sensing resistor and a first input of said voltage regulator, said output of said intrinsic safety barrier being connected to said input of said power supply.

13. The method of spraying a liquid coating material with an electrostatic rotary atomizing spray device, comprising the steps of:

directing a flow of the liquid coating material through a fluid tube extending through the electrostatic rotary atomizing spray device;

rotating a rotary atomizing head with an air turbine motor that produces an exhaust airflow; and directing at least a portion of the exhaust airflow from the air turbine motor through an air passage and then into the atomizer head to mix with the liquid coating material being dispensed by the atomizer head and to prevent the coating material from flowing into the air passage.

14. The method of claim 13 further including the steps of:

directing a first portion of the exhaust airflow from the air turbine motor into the air passage; and directing a second portion of the exhaust airflow from the air turbine motor to a location along an outer surface of the front end section of the atomizer housing.

15. The method of claim 14 wherein the electrostatic rotary atomizing spray device comprises an atomizer housing which comprises a rear end section and a front end section mounted to the rear end section forming an air gap through which the second portion of the exhaust, airflow flows out from the atomizer housing along an outer surface of the front end section of the atomizer housing.

16. The method of claim 15 further including the steps of:

directing the flow of the coating material from the fluid tube through a flow distributor mounted in the rotary atomizer head so that the coating material flows to a forward flow surface of the rotary atomizer head; and mixing the flow of exhaust air from the air passage with the coating material flowing through the flow distributor to the forward flow surface of the rotary atomizer head to propel the flow of the coating material from the forward flow surface of the rotary atomizer head.

17. The method of claim 14 further including the step of flowing the second portion of the exhaust airflow corresponding to about 75% to about 85% of the exhaust airflow to the external location and the first portion of the exhaust airflow into the air passage.

18. An electrostatic rotary atomizing spray device for spraying a liquid coating material, comprising:

an atomizer housing which defines an interior chamber therein;

a rotary drive shaft within the interior chamber of the atomizer housing, the rotary drive shaft being attached at a first end to a motor within the atomizer housing that produces exhaust air and at a second opposite end to a rotary atomizer head;

a fluid tube being disposed within the atomizer housing for directing a flow of the liquid coating material to the atomizer head; and an air passage within the atomizer housing for directing at least a portion of the exhaust air through the interior of the atomizer head.

19. The electrostatic rotary atomizing spray device of claim 18 further comprising one or more passageways in the atomizer head through which both a portion of the exhaust air and the liquid coating material flow together.

20. The electrostatic rotary atomizing spray device of claim 19 wherein the motor is an air turbine motor, and further comprising:

an air passageway within the atomizer housing for directing a first portion of the exhaust air from the air turbine motor into the air passage to flow to the atomizer head and a second portion of the exhaust air to a location external to the atomizer housing.

21. The electrostatic rotary atomizing spray device of claim 20 wherein the air passageway includes a flow restrictor through which flows the second portion of the exhaust air to the location external to the atomizer housing along an outer surface of the front end section of the atomizer housing.

22. The method of spraying a liquid coating material with an electrostatic rotary atomizing spray device, comprising the steps of:

directing a flow of the liquid coating material through a fluid tube within an atomizer housing and through an atomizer head to a forward flow surface of the atomizer head;

rotating a drive shaft with a motor, that creates exhaust air, connected at one end to turn the atomizer head connected at a second end of the drive shaft; and directing at least a portion of the exhaust air from the atomizer housing through the atomizer head to mix with the liquid coating material.

23. The method of claim 22 further including the steps of:

directing a first portion of the exhaust air from the motor, being an air turbine motor, into an air passage directing the air from the atomizer housing; and directing a second portion of the exhaust air from the air turbine motor to a location external to the atomizer housing.

24. The method of claim 23 further including the steps of:

directing the flow of the coating material from the fluid tube through a flow distributor mounted in the rotary atomizer head so that the coating material flows to a forward flow surface of the rotary atomizer head; and mixing the flow of exhaust air from the air passage with the coating material flowing through the flow distributor to the forward flow surface of the rotary atomizer head to propel the flow of the coating material from the forward flow surface of the rotary atomizer head.

25. The method of claim 22 wherein said motor is an air turbine motor with an air driven turbine wheel, further comprising the steps of:

generating a magnetic field with at least one permanent magnet affixed to said turbine wheel and arranged to rotate concentrically about said axis of rotation;

placing a first end of a pole piece adjacent to but free of contact with said at least one permanent magnet and a second end of said pole piece within an induction coil of a signal detection portion for producing an output signal representing the rotational speed of said turbine wheel;

receiving said output signal from said induction coil with a light emitting device which in turn outputs a light signal representing said rotational speed of said turbine wheel;

shining said light signal from said light emitting device onto a photo transducer/detector to generate an output signal in response to said light signal; and processing said output signal to produce a transmission signal corresponding to said light signal with said photo transducer/detector wherein the speed of said turbine wheel is detected.

26. The method of claim 22 further comprising the step of outputting a regulated intrinsically safe voltage from an intrinsic safety circuit, comprising the steps of:

outputting a current from a pass transistor;

inputting said current into an input of an intrinsic safety barrier device, transferring said current through a sense resistor and outputting a regulated intrinsically safe voltage from said intrinsic safety barrier device; and controlling said current being output from said pass transistor with a voltage regulator having a first input with a control voltage, a second input connected through a first feedback loop to an output end of said sense resistor, and an output connected to an input of said pass transistor.

* * * * *